US009842598B2

(12) United States Patent
Subasingha et al.

(10) Patent No.: US 9,842,598 B2
(45) Date of Patent: Dec. 12, 2017

(54) SYSTEMS AND METHODS FOR MITIGATING POTENTIAL FRAME INSTABILITY

(71) Applicant: QUALCOMM Incorporated, San Diego, CA (US)

(72) Inventors: Subasingha Shaminda Subasingha, San Diego, CA (US); Venkatesh Krishnan, San Diego, CA (US); Vivek Rajendran, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 118 days.

(21) Appl. No.: 14/016,004

(22) Filed: Aug. 30, 2013

(65) Prior Publication Data

US 2014/0236588 A1 Aug. 21, 2014

Related U.S. Application Data

(60) Provisional application No. 61/767,431, filed on Feb. 21, 2013.

(51) Int. Cl.

| | |
|---|---|
| ***G10L 19/02*** | (2013.01) |
| ***G10L 19/04*** | (2013.01) |
| ***G10L 19/06*** | (2013.01) |
| ***G10L 19/07*** | (2013.01) |
| ***G10L 19/005*** | (2013.01) |

(52) U.S. Cl.

CPC ..... *G10L 19/02* (2013.01); *G10L 19/005* (2013.01); *G10L 19/04* (2013.01); *G10L 19/06* (2013.01); *G10L 19/07* (2013.01)

(58) Field of Classification Search

CPC ..... G10L 19/04; G10L 19/06; G10L 19/005

See application file for complete search history.

(56) References Cited

U.S. PATENT DOCUMENTS

| | | | |
|---|---|---|---|
| 4,710,960 | A | 12/1987 | Sato |
| 5,699,478 | A | 12/1997 | Nahumi |
| 5,987,406 | A | 11/1999 | Honkanen et al. |

(Continued)

FOREIGN PATENT DOCUMENTS

| | | | |
|---|---|---|---|
| CA | 2556797 | A1 | 8/2005 |
| CN | 1535461 | A | 10/2004 |

(Continued)

OTHER PUBLICATIONS

De Martin J.C., et al., "Improved Frame Erasure Concealment for CELP-Based Coders", 2000 IEEE International Conference on Acoustics, Speech, and Signal Processing, vol. 3, Jun. 5, 2000, pp. 1483-1486.

(Continued)

*Primary Examiner* — Paras D Shah
*Assistant Examiner* — Bryan Blankenagel
(74) *Attorney, Agent, or Firm* — Austin Rapp & Hardman, P.C.

(57) ABSTRACT

A method for mitigating potential frame instability by an electronic device is described. The method includes obtaining a frame subsequent in time to an erased frame. The method also includes determining whether the frame is potentially unstable. The method further includes applying a substitute weighting value to generate a stable frame parameter if the frame is potentially unstable.

36 Claims, 19 Drawing Sheets

(56) References Cited

U.S. PATENT DOCUMENTS 6,188,980 B1* 2/2001 Thyssen ..... 704/230
6,324,503 B1* 11/2001 Manjunath et al. ..... 704/226
6,574,593 B1* 6/2003 Gao ..... G10L 19/00 704/222
6,584,438 B1* 6/2003 Manjunath et al. ..... 704/228
6,757,654 B1 6/2004 Westerlund et al.
6,775,649 B1* 8/2004 DeMartin ..... 704/201
6,810,377 B1* 10/2004 Ho ..... G10L 19/005 704/208
6,826,527 B1* 11/2004 Unno ..... G10L 19/005 704/205
6,862,567 B1* 3/2005 Gao ..... G10L 21/0208 704/225
7,295,974 B1* 11/2007 Stachurski ..... G10L 19/12 704/219
8,078,458 B2* 12/2011 Zopf et al. ..... 704/219
8,990,094 B2 3/2015 Krishnan et al.
2002/0016711 A1* 2/2002 Manjunath ..... G10L 19/097 704/258
2002/0091523 A1* 7/2002 Makinen ..... G10L 19/005 704/258
2002/0123887 A1* 9/2002 Unno ..... 704/220
2003/0055632 A1* 3/2003 Chen ..... 704/219
2004/0002856 A1 1/2004 Bhaskar et al.
2004/0049380 A1* 3/2004 Ehara ..... G10L 19/012 704/219
2005/0049853 A1* 3/2005 Lee ..... G10L 19/005 704/201
2005/0065788 A1* 3/2005 Stachurski ..... G10L 19/20 704/229
2005/0154584 A1* 7/2005 Jelinek et al. ..... 704/219
2006/0178872 A1* 8/2006 Sung et al. ..... 704/205
2008/0235554 A1* 9/2008 Simmons ..... G06F 11/0751 714/752
2008/0249767 A1* 10/2008 Ertan ..... 704/219
2009/0204412 A1 8/2009 Kovesi et al.
2010/0023325 A1* 1/2010 Bessette et al. ..... 704/219
2010/0057447 A1* 3/2010 Ehara ..... 704/219
2010/0174541 A1* 7/2010 Vos ..... G10L 19/04 704/230
2010/0286990 A1* 11/2010 Biswas ..... G10L 19/035 704/500
2010/0312553 A1* 12/2010 Fang et al. ..... 704/226
2011/0040558 A1 2/2011 Ehara
2011/0082693 A1* 4/2011 Krishnan et al. ..... 704/225
2011/0125505 A1 5/2011 Vaillancourt et al.
2011/0295598 A1* 12/2011 Yang ..... G10L 21/038 704/205
2012/0095756 A1* 4/2012 Sung ..... G10L 19/06 704/219
2012/0271644 A1* 10/2012 Bessette ..... G10L 19/03 704/500

FOREIGN PATENT DOCUMENTS

CN 102089810 A 6/2011
EP 0577488 A1 1/1994
TW 201246186 A 11/2012
WO 2012036988 A1 3/2012

OTHER PUBLICATIONS

"General Aspects of Digital Transmission Systems, Coding of Speech At 8 KBIT/S Using Conjugate-Structure Algebraic-Code-Excited Linear-Prediction (CS-ACELP)", ITU-T Recommendation G.729, XX, XX, Mar. 1, 1996 (Mar. 1, 1996), pp. 1-39, XP002170340.
International Search Report and Written Opinion—PCT/US2013/057873—ISA/EPO—Feb. 12, 2014.
Taiwan Search Report—TW103101040—TIPO—Mar. 23, 2015.

* cited by examiner

Time 1101

SYSTEMS AND METHODS FOR MITIGATING POTENTIAL FRAME INSTABILITY

RELATED APPLICATIONS

This application is related to and claims priority to U.S. Provisional Patent Application Ser. No. 61/767,431 filed Feb. 21, 2013, for "SYSTEMS AND METHODS FOR CORRECTING A POTENTIAL LINE SPECTRAL FREQUENCY INSTABILITY."

TECHNICAL FIELD

The present disclosure relates generally to electronic devices. More specifically, the present disclosure relates to systems and methods for mitigating potential frame instability.

BACKGROUND

In the last several decades, the use of electronic devices has become common. In particular, advances in electronic technology have reduced the cost of increasingly complex and useful electronic devices. Cost reduction and consumer demand have proliferated the use of electronic devices such that they are practically ubiquitous in modern society. As the use of electronic devices has expanded, so has the demand for new and improved features of electronic devices. More specifically, electronic devices that perform new functions and/or that perform functions faster, more efficiently or with higher quality are often sought after.

Some electronic devices (e.g., cellular phones, smartphones, audio recorders, camcorders, computers, etc.) utilize audio signals. These electronic devices may encode, store and/or transmit the audio signals. For example, a smartphone may obtain, encode and transmit a speech signal for a phone call, while another smartphone may receive and decode the speech signal.

However, particular challenges arise in encoding, transmitting and decoding of audio signals. For example, an audio signal may be encoded in order to reduce the amount of bandwidth required to transmit the audio signal. When a portion of the audio signal is lost in transmission, it may be difficult to present an accurately decoded audio signal. As can be observed from this discussion, systems and methods that improve decoding may be beneficial.

SUMMARY

A method for mitigating potential frame instability by an electronic device is described. The method includes obtaining a frame subsequent in time to an erased frame. The method also includes determining whether the frame is potentially unstable. The method further includes applying a substitute weighting value to generate a stable frame parameter if the frame is potentially unstable. The frame parameter may be a frame mid line spectral frequency vector. The method may include applying a received weighting vector to generate a current frame mid line spectral frequency vector.

The substitute weighting value may be between 0 and 1. Generating the stable frame parameter may include applying the substitute weighting value to a current frame end line spectral frequency vector and a previous frame end line spectral frequency vector. Generating the stable frame parameter may include determining a substitute current frame mid line spectral frequency vector that is equal to a product of a current frame end line spectral frequency vector and the substitute weighting value plus a product of a previous frame end line spectral frequency vector and a difference of one and the substitute weighting value. The substitute weighting value may be selected based on at least one of a classification of two frames and a line spectral frequency difference between the two frames.

Determining whether the frame is potentially unstable may be based on whether a current frame mid line spectral frequency is ordered in accordance with a rule before any reordering. Determining whether the frame is potentially unstable may be based on whether the frame is within a threshold number of frames after the erased frame. Determining whether the frame is potentially unstable may be based on whether any frame between the frame and the erased frame utilizes non-predictive quantization.

An electronic device for mitigating potential frame instability is also described. The electronic device includes frame parameter determination circuitry that obtains a frame subsequent in time to an erased frame. The electronic device also includes stability determination circuitry coupled to the frame parameter determination circuitry. The stability determination circuitry determines whether the frame is potentially unstable. The electronic device further includes weighting value substitution circuitry coupled to the stability determination circuitry. The weighting value substitution circuitry applies a substitute weighting value to generate a stable frame parameter if the frame is potentially unstable.

A computer-program product for mitigating potential frame instability is also described. The computer-program product includes a non-transitory tangible computer-readable medium with instructions. The instructions include code for causing an electronic device to obtain a frame subsequent in time to an erased frame. The instructions also include code for causing the electronic device to determine whether the frame is potentially unstable. The instructions further include code for causing the electronic device to apply a substitute weighting value to generate a stable frame parameter if the frame is potentially unstable.

An apparatus for mitigating potential frame instability is also described. The apparatus includes means for obtaining a frame subsequent in time to an erased frame. The apparatus also includes means for determining whether the frame is potentially unstable. The apparatus further includes means for applying a substitute weighting value to generate a stable frame parameter if the frame is potentially unstable.

DETAILED DESCRIPTION

Various configurations are now described with reference to the Figures, where like reference numbers may indicate functionally similar elements. The systems and methods as generally described and illustrated in the Figures herein could be arranged and designed in a wide variety of different configurations. Thus, the following more detailed description of several configurations, as represented in the Figures, is not intended to limit scope, as claimed, but is merely representative of the systems and methods.

Figure 1:
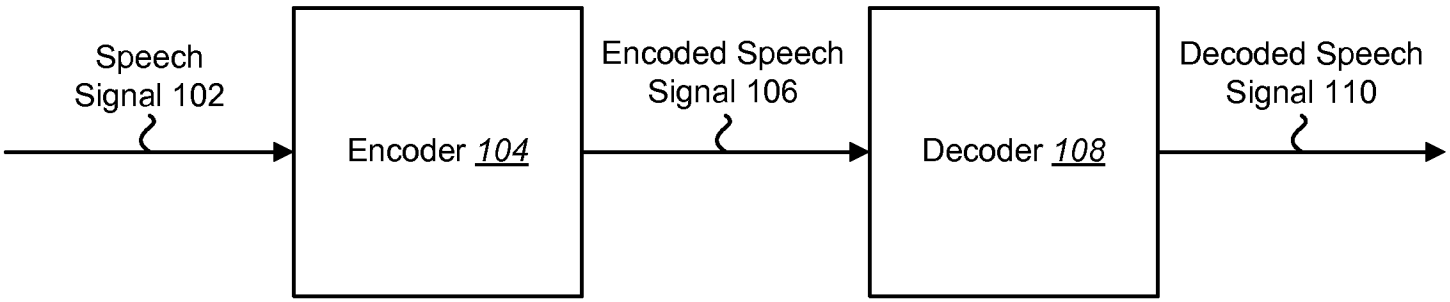
FIG. 1 is a block diagram illustrating a general example of an encoder and a decoder.

FIG. 1 is a block diagram illustrating a general example of an encoder 104 and a decoder 108. The encoder 104 receives a speech signal 102. The speech signal 102 may be a speech signal in any frequency range. For example, the speech signal 102 may be a full band signal with an approximate frequency range of 0-24 kilohertz (kHz), a superwideband signal with an approximate frequency range of 0-16 kHz, a wideband signal with an approximate frequency range of 0-8 kHz, a narrowband signal with an approximate frequency range of 0-4 kHz, a lowband signal with an approximate frequency range of 50-300 hertz (Hz) or a highband signal with an approximate frequency range of 4-8 kHz. Other possible frequency ranges for the speech signal 102 include 300-3400 Hz (e.g., the frequency range of the Public Switched Telephone Network (PSTN)), 14-20 kHz, 16-20 kHz and 16-32 kHz. In some configurations, the speech signal 102 may be sampled at 16 kHz and may have an approximate frequency range of 0-8 kHz.

The encoder 104 encodes the speech signal 102 to produce an encoded speech signal 106. In general, the encoded speech signal 106 includes one or more parameters that represent the speech signal 102. One or more of the parameters may be quantized. Examples of the one or more parameters include filter parameters (e.g., weighting factors, line spectral frequencies (LSFs), line spectral pairs (LSPs), immittance spectral frequencies (ISFs), immittance spectral pairs (ISPs), partial correlation (PARCOR) coefficients, reflection coefficients and/or log-area-ratio values, etc.) and parameters included in an encoded excitation signal (e.g., gain factors, adaptive codebook indices, adaptive codebook gains, fixed codebook indices and/or fixed codebook gains, etc.). The parameters may correspond to one or more frequency bands. The decoder 108 decodes the encoded speech signal 106 to produce a decoded speech signal 110. For example, the decoder 108 constructs the decoded speech signal 110 based on the one or more parameters included in the encoded speech signal 106. The decoded speech signal 110 may be an approximate reproduction of the original speech signal 102.

The encoder 104 may be implemented in hardware (e.g., circuitry), software or a combination of both. For example, the encoder 104 may be implemented as an application-specific integrated circuit (ASIC) or as a processor with instructions. Similarly, the decoder 108 may be implemented in hardware (e.g., circuitry), software or a combination of both. For example, the decoder 108 may be implemented as an application-specific integrated circuit (ASIC) or as a processor with instructions. The encoder 104 and the decoder 108 may be implemented on separate electronic devices or on the same electronic device.

Figure 2:
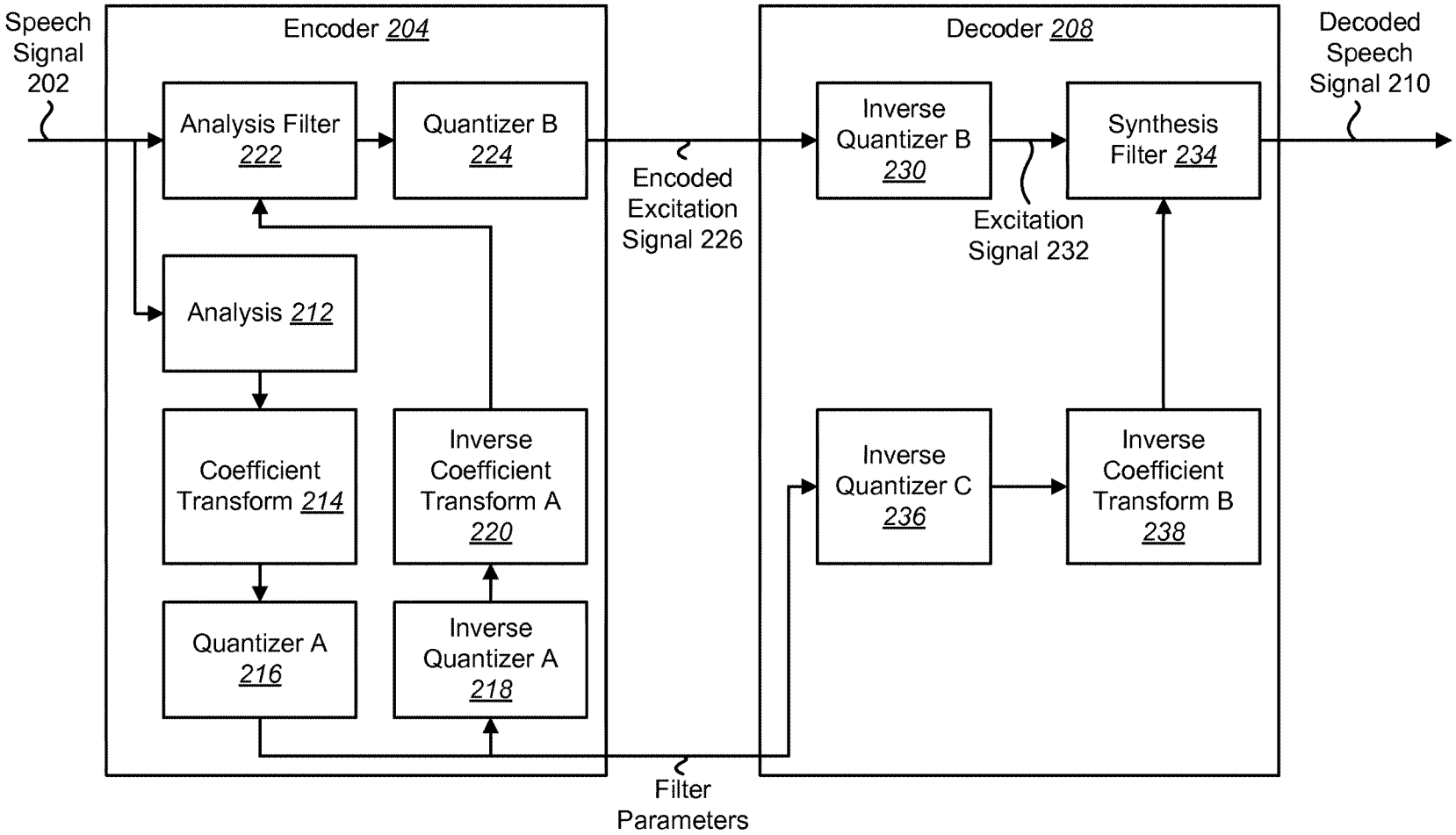
FIG. 2 is a block diagram illustrating an example of a basic implementation of an encoder and a decoder.

FIG. 2 is a block diagram illustrating an example of a basic implementation of an encoder 204 and a decoder 208. The encoder 204 may be one example of the encoder 104 described in connection with FIG. 1. The encoder 204 may include an analysis module 212, a coefficient transform 214, quantizer A 216, inverse quantizer A 218, inverse coefficient transform A 220, an analysis filter 222 and quantizer B 224. One or more of the components of the encoder 204 and/or decoder 208 may be implemented in hardware (e.g., circuitry), software or a combination of both.

The encoder 204 receives a speech signal 202. It should be noted that the speech signal 202 may include any frequency range as described above in connection with FIG. 1 (e.g., an entire band of speech frequencies or a subband of speech frequencies).

In this example, the analysis module 212 encodes the spectral envelope of a speech signal 202 as a set of linear prediction (LP) coefficients (e.g., analysis filter coefficients A(z), which may be applied to produce an all-pole synthesis filter 1/A(z), where z is a complex number). The analysis module 212 typically processes the input signal as a series of non-overlapping frames of the speech signal 202, with a new set of coefficients being calculated for each frame or subframe. In some configurations, the frame period may be a period over which the speech signal 202 may be expected to be locally stationary. One common example of the frame period is 20 milliseconds (ms) (equivalent to 160 samples at a sampling rate of 8 kHz, for example). In one example, the analysis module 212 is configured to calculate a set of ten linear prediction coefficients to characterize the formant structure of each 20-ms frame. It is also possible to implement the analysis module 212 to process the speech signal 202 as a series of overlapping frames.

The analysis module 212 may be configured to analyze the samples of each frame directly, or the samples may be weighted first according to a windowing function (e.g., a Hamming window). The analysis may also be performed over a window that is larger than the frame, such as a 30-ms window. This window may be symmetric (e.g., 5-20-5, such that it includes the 5 milliseconds immediately before and after the 20-millisecond frame) or asymmetric (e.g., 10-20, such that it includes the last 10 milliseconds of the preceding frame). The analysis module 212 is typically configured to calculate the linear prediction coefficients using a Levinson-Durbin recursion or the Leroux-Gueguen algorithm. In another implementation, the analysis module may be configured to calculate a set of cepstral coefficients for each frame instead of a set of linear prediction coefficients.

The output rate of the encoder 204 may be reduced significantly, with relatively little effect on reproduction quality, by quantizing the coefficients. Linear prediction coefficients are difficult to quantize efficiently and are usually mapped into another representation, such as LSFs for quantization and/or entropy encoding. In the example of FIG. 2, the coefficient transform 214 transforms the set of coefficients into a corresponding LSF vector (e.g., set of LSF dimensions). Other one-to-one representations of coefficients include LSPs, PARCOR coefficients, reflection coefficients, log-area-ratio values, ISPs and ISFs. For example, ISFs may be used in the GSM (Global System for Mobile Communications) AMR-WB (Adaptive Multirate-Wideband) codec. For convenience, the term "line spectral frequencies," "LSF dimensions," "LSF vectors" and related terms may be used to refer to one or more of LSFs, LSPs, ISFs, ISPs, PARCOR coefficients, reflection coefficients and log-area-ratio values. Typically, a transform between a set of coefficients and a corresponding LSF vector is reversible, but some configurations may include implementations of the encoder 204 in which the transform is not reversible without error.

Quantizer A 216 is configured to quantize the LSF vector (or other coefficient representation). The encoder 204 may output the result of this quantization as filter parameters 228. Quantizer A 216 typically includes a vector quantizer that encodes the input vector (e.g., the LSF vector) as an index to a corresponding vector entry in a table or codebook.

As seen in FIG. 2, the encoder 204 also generates a residual signal by passing the speech signal 202 through an analysis filter 222 (also called a whitening or prediction error filter) that is configured according to the set of coefficients. The analysis filter 222 may be implemented as a finite impulse response (FIR) filter or an infinite impulse response (IIR) filter. This residual signal will typically contain perceptually important information of the speech frame, such as long-term structure relating to pitch, that is not represented in the filter parameters 228. Quantizer B 224 is configured to calculate a quantized representation of this residual signal for output as an encoded excitation signal 226. In some configurations, quantizer B 224 includes a vector quantizer that encodes the input vector as an index to a corresponding vector entry in a table or codebook. Additionally or alternatively, quantizer B 224 may be configured to send one or more parameters from which the vector may be generated dynamically at the decoder, rather than retrieved from storage, as in a sparse codebook method. Such a method is used in coding schemes such as algebraic CELP (code-excited linear prediction) and codecs such as 3GPP2 (Third Generation Partnership 2) EVRC (Enhanced Variable Rate Codec). In some configurations, the encoded excitation signal 226 and the filter parameters 228 may be included in an encoded speech signal 106.

It may be beneficial for the encoder 204 to generate the encoded excitation signal 226 according to the same filter parameter values that will be available to the corresponding decoder 208. In this manner, the resulting encoded excitation signal 226 may already account to some extent for non-idealities in those parameter values, such as quantization error. Accordingly, it may be beneficial to configure the analysis filter 222 using the same coefficient values that will be available at the decoder 208. In the basic example of the encoder 204 as illustrated in FIG. 2, inverse quantizer A 218 dequantizes the filter parameters 228. Inverse coefficient transform A 220 maps the resulting values back to a corresponding set of coefficients. This set of coefficients is used to configure the analysis filter 222 to generate the residual signal that is quantized by quantizer B 224.

Some implementations of the encoder 204 are configured to calculate the encoded excitation signal 226 by identifying one among a set of codebook vectors that best matches the residual signal. It is noted, however, that the encoder 204 may also be implemented to calculate a quantized representation of the residual signal without actually generating the residual signal. For example, the encoder 204 may be configured to use a number of codebook vectors to generate corresponding synthesized signals (according to a current set of filter parameters, for example) and to select the codebook vector associated with the generated signal that best matches the original speech signal 202 in a perceptually weighted domain.

The decoder 208 may include inverse quantizer B 230, inverse quantizer C 236, inverse coefficient transform B 238 and a synthesis filter 234. Inverse quantizer C 236 dequantizes the filter parameters 228 (an LSF vector, for example), and inverse coefficient transform B 238 transforms the LSF vector into a set of coefficients (for example, as described above with reference to inverse quantizer A 218 and inverse coefficient transform A 220 of the encoder 204). Inverse quantizer B 230 dequantizes the encoded excitation signal 226 to produce an excitation signal 232. Based on the coefficients and the excitation signal 232, the synthesis filter 234 synthesizes a decoded speech signal 210. In other words, the synthesis filter 234 is configured to spectrally shape the excitation signal 232 according to the dequantized coefficients to produce the decoded speech signal 210. In some configurations, the decoder 208 may also provide the excitation signal 232 to another decoder, which may use the excitation signal 232 to derive an excitation signal of another frequency band (e.g., a highband). In some implementations, the decoder 208 may be configured to provide additional information to another decoder that relates to the excitation signal 232, such as spectral tilt, pitch gain and lag and speech mode.

The system of the encoder 204 and the decoder 208 is a basic example of an analysis-by-synthesis speech codec. Codebook excitation linear prediction coding is one popular family of analysis-by-synthesis coding. Implementations of such coders may perform waveform encoding of the residual, including such operations as selection of entries from fixed and adaptive codebooks, error minimization operations and/or perceptual weighting operations. Other implementations of analysis-by-synthesis coding include mixed excitation linear prediction (MELP), algebraic CELP (ACELP), relaxation CELP (RCELP), regular pulse excitation (RPE), multi-pulse excitation (MPE), multi-pulse CELP (MP-CELP) and vector-sum excited linear prediction (VSELP) coding. Related coding methods include multi-band excitation (MBE) and prototype waveform interpolation (PWI) coding. Examples of standardized analysis-by-synthesis speech codecs include the ETSI (European Telecommunications Standards Institute)-GSM full rate codec (GSM 06.10) (which uses residual excited linear prediction (RELP)), the GSM enhanced full rate codec (ETSI-GSM 06.60), the ITU (International Telecommunication Union) standard 11.8 kilobits per second (kbps) G.729 Annex E coder, the IS (Interim Standard)-641 codecs for IS-136 (a time-division multiple access scheme), the GSM adaptive multirate (GSM-AMR) codecs and the 4GV™ (Fourth-Generation Vocoder™) codec (QUALCOMM Incorporated, San Diego, Calif.). The encoder 204 and corresponding decoder 208 may be implemented according to any of these technologies, or any other speech coding technology (whether known or to be developed) that represents a speech signal as (A) a set of parameters that describe a filter and (B) an excitation signal used to drive the described filter to reproduce the speech signal.

Even after the analysis filter 222 has removed the coarse spectral envelope from the speech signal 202, a considerable amount of fine harmonic structure may remain, especially for voiced speech. Periodic structure is related to pitch, and different voiced sounds spoken by the same speaker may have different formant structures but similar pitch structures.

Coding efficiency and/or speech quality may be increased by using one or more parameter values to encode characteristics of the pitch structure. One important characteristic of the pitch structure is the frequency of the first harmonic (also called the fundamental frequency), which is typically in the range of 60 to 400 hertz (Hz). This characteristic is typically encoded as the inverse of the fundamental frequency, also called the pitch lag. The pitch lag indicates the number of samples in one pitch period and may be encoded as one or more codebook indices. Speech signals from male speakers tend to have larger pitch lags than speech signals from female speakers.

Another signal characteristic relating to the pitch structure is periodicity, which indicates the strength of the harmonic structure or, in other words, the degree to which the signal is harmonic or non-harmonic. Two typical indicators of periodicity are zero crossings and normalized autocorrelation functions (NACFs). Periodicity may also be indicated by the pitch gain, which is commonly encoded as a codebook gain (e.g., a quantized adaptive codebook gain).

The encoder 204 may include one or more modules configured to encode the long-term harmonic structure of the speech signal 202. In some approaches to CELP encoding, the encoder 204 includes an open-loop linear predictive coding (LPC) analysis module, which encodes the short-term characteristics or coarse spectral envelope, followed by a closed-loop long-term prediction analysis stage, which encodes the fine pitch or harmonic structure. The short-term characteristics are encoded as coefficients (e.g., filter parameters 228), and the long-term characteristics are encoded as values for parameters such as pitch lag and pitch gain. For example, the encoder 204 may be configured to output the encoded excitation signal 226 in a form that includes one or more codebook indices (e.g., a fixed codebook index and an adaptive codebook index) and corresponding gain values. Calculation of this quantized representation of the residual signal (e.g., by quantizer B 224) may include selecting such indices and calculating such values. Encoding of the pitch structure may also include interpolation of a pitch prototype waveform, which operation may include calculating a difference between successive pitch pulses. Modeling of the long-term structure may be disabled for frames corresponding to unvoiced speech, which is typically noise-like and unstructured.

Some implementations of the decoder 208 may be configured to output the excitation signal 232 to another decoder (e.g., a highband decoder) after the long-term structure (pitch or harmonic structure) has been restored. For example, such a decoder may be configured to output the excitation signal 232 as a dequantized version of the encoded excitation signal 226. Of course, it is also possible to implement the decoder 208 such that the other decoder performs dequantization of the encoded excitation signal 226 to obtain the excitation signal 232.

Figure 3:
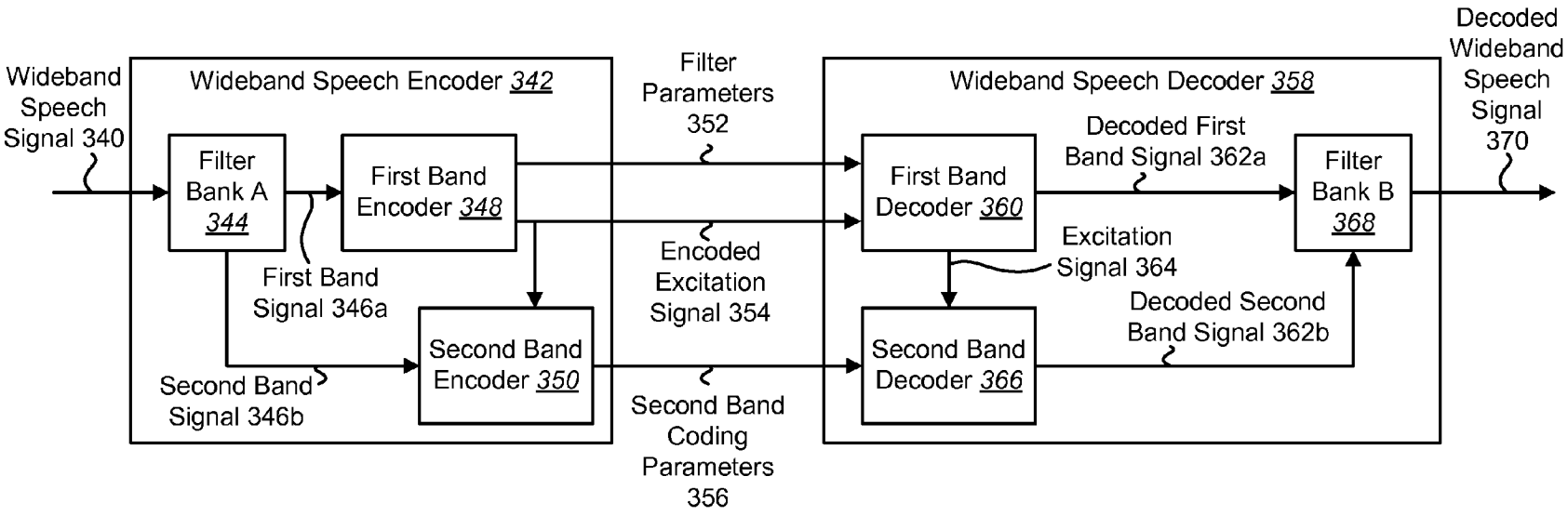
FIG. 3 is a block diagram illustrating an example of a wideband speech encoder and a wideband speech decoder.

FIG. 3 is a block diagram illustrating an example of a wideband speech encoder 342 and a wideband speech decoder 358. One or more components of the wideband speech encoder 342 and/or the wideband speech decoder 358 may be implemented in hardware (e.g., circuitry), software or a combination of both. The wideband speech encoder 342 and the wideband speech decoder 358 may be implemented on separate electronic devices or on the same electronic device.

The wideband speech encoder 342 includes filter bank A 344, a first band encoder 348 and a second band encoder 350. Filter bank A 344 is configured to filter a wideband speech signal 340 to produce a first band signal 346*a* (e.g., a narrowband signal) and a second band signal 346*b* (e.g., a highband signal).

The first band encoder 348 is configured to encode the first band signal 346*a* to produce filter parameters 352 (e.g., narrowband (NB) filter parameters) and an encoded excitation signal 354 (e.g., an encoded narrowband excitation signal). In some configurations, the first band encoder 348 may produce the filter parameters 352 and the encoded excitation signal 354 as codebook indices or in another quantized form. In some configurations, the first band encoder 348 may be implemented in accordance with the encoder 204 described in connection with FIG. 2.

The second band encoder 350 is configured to encode the second band signal 346*b* (e.g., a highband signal) according to information in the encoded excitation signal 354 to produce second band coding parameters 356 (e.g., highband coding parameters). The second band encoder 350 may be configured to produce second band coding parameters 356 as codebook indices or in another quantized form. One particular example of a wideband speech encoder 342 is configured to encode the wideband speech signal 340 at a rate of about 8.55 kbps, with about 7.55 kbps being used for the filter parameters 352 and encoded excitation signal 354, and about 1 kbps being used for the second band coding parameters 356. In some implementations, the filter parameters 352, the encoded excitation signal 354 and the second band coding parameters 356 may be included in an encoded speech signal 106.

In some configurations, the second band encoder 350 may be implemented similar to the encoder 204 described in connection with FIG. 2. For example, the second band encoder 350 may produce second band filter parameters (as part of the second band coding parameters 356, for instance) as described in connection with the encoder 204 described in connection with FIG. 2. However, the second band encoder 350 may differ in some respects. For example, the second band encoder 350 may include a second band excitation generator, which may generate a second band excitation signal based on the encoded excitation signal 354. The second band encoder 350 may utilize the second band excitation signal to produce a synthesized second band signal and to determine a second band gain factor. In some configurations, the second band encoder 350 may quantize the second band gain factor. Accordingly, examples of the second band coding parameters 356 include second band filter parameters and a quantized second band gain factor.

It may be beneficial to combine the filter parameters 352, the encoded excitation signal 354 and the second band coding parameters 356 into a single bitstream. For example, it may be beneficial to multiplex the encoded signals together for transmission (e.g., over a wired, optical, or wireless transmission channel) or for storage, as an encoded wideband speech signal. In some configurations, the wideband speech encoder 342 includes a multiplexer (not shown) configured to combine the filter parameters 352, encoded excitation signal 354 and second band coding parameters 356 into a multiplexed signal. The filter parameters 352, the encoded excitation signal 354 and the second band coding parameters 356 may be examples of parameters included in an encoded speech signal 106 as described in connection with FIG. 1.

In some implementations, an electronic device that includes the wideband speech encoder 342 may also include circuitry configured to transmit the multiplexed signal into a transmission channel such as a wired, optical or wireless channel. Such an electronic device may also be configured to perform one or more channel encoding operations on the signal, such as error correction encoding (e.g., rate-compatible convolutional encoding) and/or error detection encoding (e.g., cyclic redundancy encoding), and/or one or more layers of network protocol encoding (e.g., Ethernet, Transmission Control Protocol/Internet Protocol (TCP/IP), cdma2000, etc.).

It may be beneficial for the multiplexer to be configured to embed the filter parameters 352 and the encoded excitation signal 354 as a separable substream of the multiplexed signal, such that the filter parameters 352 and encoded excitation signal 354 may be recovered and decoded independently of another portion of the multiplexed signal such as a highband and/or lowband signal. For example, the multiplexed signal may be arranged such that the filter parameters 352 and encoded excitation signal 354 may be recovered by stripping away the second band coding parameters 356. One potential advantage of such a feature is to avoid the need for transcoding the second band coding parameters 356 before passing it to a system that supports decoding of the filter parameters 352 and encoded excitation signal 354 but does not support decoding of the second band coding parameters 356.

The wideband speech decoder 358 may include a first band decoder 360, a second band decoder 366 and filter bank B 368. The first band decoder 360 (e.g., a narrowband decoder) is configured to decode the filter parameters 352 and encoded excitation signal 354 to produce a decoded first band signal 362*a* (e.g., a decoded narrowband signal). The second band decoder 366 is configured to decode the second band coding parameters 356 according to an excitation signal 364 (e.g., a narrowband excitation signal), based on the encoded excitation signal 354, to produce a decoded second band signal 362*b* (e.g., a decoded highband signal). In this example, the first band decoder 360 is configured to provide the excitation signal 364 to the second band decoder 366. The filter bank 368 is configured to combine the decoded first band signal 362*a* and the decoded second band signal 362*b* to produce a decoded wideband speech signal 370.

Some implementations of the wideband speech decoder 358 may include a demultiplexer (not shown) configured to produce the filter parameters 352, the encoded excitation signal 354 and the second band coding parameters 356 from a multiplexed signal. An electronic device including the wideband speech decoder 358 may include circuitry configured to receive the multiplexed signal from a transmission channel such as a wired, optical or wireless channel. Such an electronic device may also be configured to perform one or more channel decoding operations on the signal, such as error correction decoding (e.g., rate-compatible convolutional decoding) and/or error detection decoding (e.g., cyclic redundancy decoding), and/or one or more layers of network protocol decoding (e.g., Ethernet, TCP/IP, cdma2000).

Filter bank A 344 in the wideband speech encoder 342 is configured to filter an input signal according to a split-band scheme to produce a first band signal 346*a* (e.g., a narrowband or low-frequency subband signal) and a second band signal 346*b* (e.g., a highband or high-frequency subband signal). Depending on the design criteria for the particular application, the output subbands may have equal or unequal bandwidths and may be overlapping or nonoverlapping. A configuration of filter bank A 344 that produces more than two subbands is also possible. For example, filter bank A 344 may be configured to produce one or more lowband signals that include components in a frequency range below that of the first band signal 346*a* (such as the range of 50-300 hertz (Hz), for example). It is also possible for filter bank A 344 to be configured to produce one or more additional highband signals that include components in a frequency range above that of the second band signal 346*b* (such as a range of 14-20, 16-20 or 16-32 kilohertz (kHz), for example). In such a configuration, the wideband speech encoder 342 may be implemented to encode the signal or signals separately and a multiplexer may be configured to include the additional encoded signal or signals in a multiplexed signal (as one or more separable portions, for example).

Figure 4:
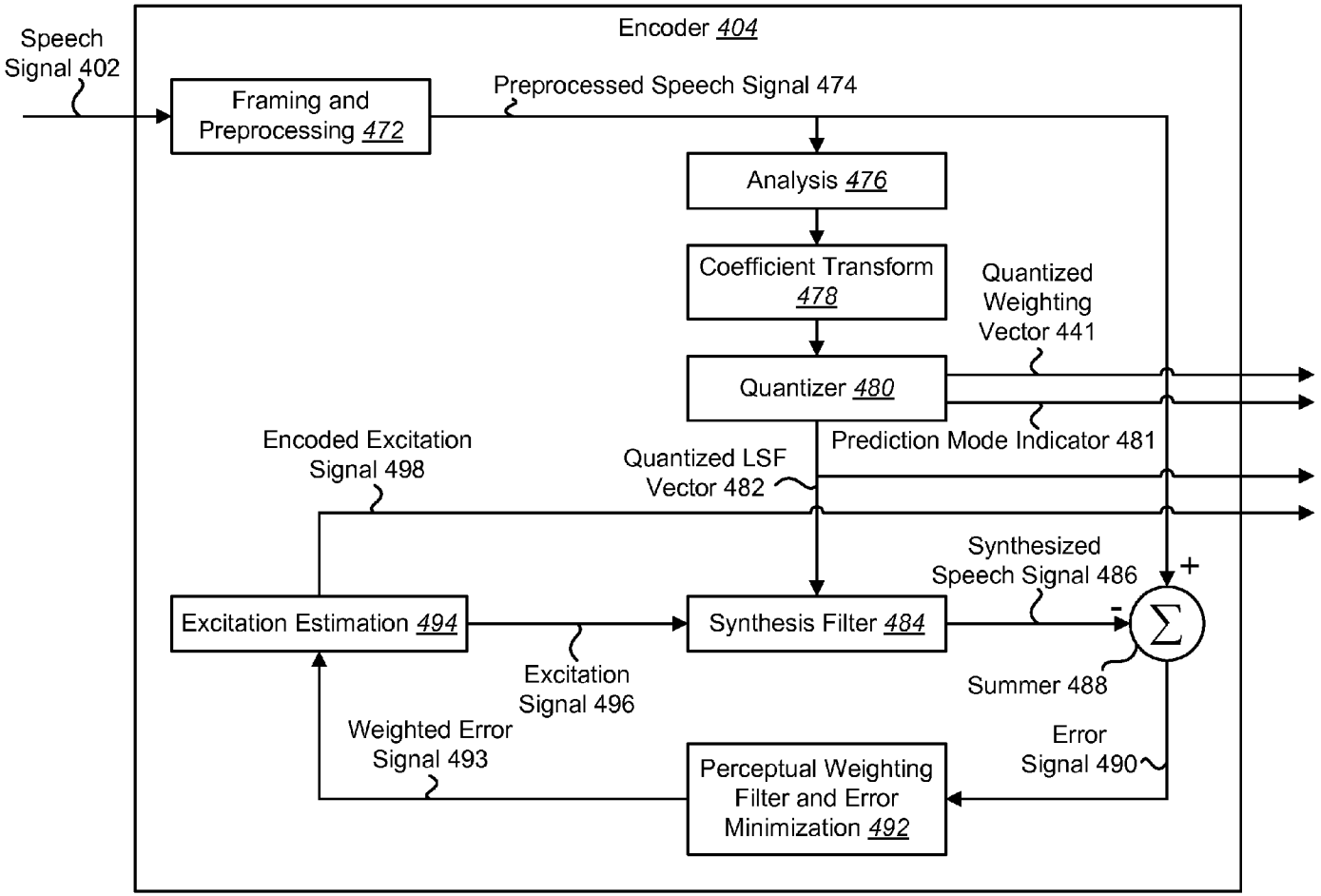
FIG. 4 is a block diagram illustrating a more specific example of an encoder.

FIG. 4 is a block diagram illustrating a more specific example of an encoder 404. In particular, FIG. 4 illustrates a CELP analysis-by-synthesis architecture for low bit rate speech encoding. In this example, the encoder 404 includes a framing and preprocessing module 472, an analysis module 476, a coefficient transform 478, a quantizer 480, a synthesis filter 484, a summer 488, a perceptual weighting filter and error minimization module 492 and an excitation estimation module 494. It should be noted that the encoder 404 and one or more of the components of the encoder 404 may be implemented in hardware (e.g., circuitry), software or a combination of both.

The speech signal 402 (e.g., input speech s) may be an electronic signal that contains speech information. For example, an acoustic speech signal may be captured by a microphone and sampled to produce the speech signal 402. In some configurations, the speech signal 402 may be sampled at 16 kHz. The speech signal 402 may comprise a range of frequencies as described above in connection with FIG. 1.

The speech signal 402 may be provided to the framing and preprocessing module 472. The framing and preprocessing module 472 may divide the speech signal 402 into a series of frames. Each frame may be a particular time period. For example, each frame may correspond to 20 ms of the speech signal 402. The framing and preprocessing module 472 may perform other operations on the speech signal, such as filtering (e.g., one or more of low-pass, high-pass and band-pass filtering). Accordingly, the framing and preprocessing module 472 may produce a preprocessed speech signal 474 (e.g., S(l), where l is a sample number) based on the speech signal 402.

The analysis module 476 may determine a set of coefficients (e.g., linear prediction analysis filter A(z)). For example, the analysis module 476 may encode the spectral envelope of the preprocessed speech signal 474 as a set of coefficients as described in connection with FIG. 2.

The coefficients may be provided to the coefficient transform 478. The coefficient transform 478 transforms the set of coefficients into a corresponding LSF vector (e.g., LSFs, LSPs, ISFs, ISPs, etc.) as described above in connection with FIG. 2.

The LSF vector is provided to the quantizer 480. The quantizer 480 quantizes the LSF vector into a quantized LSF vector 482. For example, the quantizer 480 may perform vector quantization on the LSF vector to yield the quantized LSF vector 482. In some configurations, LSF vectors may be generated and/or quantized on a subframe basis. In these configurations, only quantized LSF vectors corresponding to certain subframes (e.g., the last or end subframe of each frame) may be sent to a speech decoder. In these configurations, the quantizer 480 may also determine a quantized weighting vector 441. Weighting vectors are used to quantize LSF vectors (e.g., mid LSF vectors) between LSF vectors corresponding to the subframes that are sent. The weighting vectors may be quantized. For example, the quantizer 480 may determine an index of a codebook or lookup table corresponding to a weighting vector that best matches the actual weighting vector. The quantized weighting vectors 441 (e.g., the indices) may be sent to a speech decoder. The quantized weighting vector 441 and the quantized LSF vector 482 may be examples of the filter parameters 228 described above in connection with FIG. 2.

The quantizer 480 may produce a prediction mode indicator 481 that indicates the prediction mode for each frame. The prediction mode indicator 481 may be sent to a decoder. In some configurations, the prediction mode indicator 481 may indicate one of two prediction modes (e.g., whether predictive quantization or non-predictive quantization is utilized) for a frame. For example, the prediction mode indicator 481 may indicate whether a frame is quantized based on a foregoing frame (e.g., predictive) or not (e.g., non-predictive). The prediction mode indicator 481 may indicate the prediction mode of the current frame. In some configurations, the prediction mode indicator 481 may be a bit that is sent to a decoder that indicates whether the frame is quantized with predictive or non-predictive quantization.

The quantized LSF vector 482 is provided to the synthesis filter 484. The synthesis filter 484 produces a synthesized speech signal 486 (e.g., reconstructed speech $\hat{s}(l)$, where l is a sample number) based on the LSF vector 482 (e.g., quantized coefficients) and an excitation signal 496. For example, the synthesis filter 484 filters the excitation signal 496 based on the quantized LSF vector 482 (e.g., 1/A(z)).

The synthesized speech signal 486 is subtracted from the preprocessed speech signal 474 by the summer 488 to yield an error signal 490 (also referred to as a prediction error signal). The error signal 490 is provided to the perceptual weighting filter and error minimization module 492.

The perceptual weighting filter and error minimization module 492 produces a weighted error signal 493 based on the error signal 490. For example, not all of the components (e.g., frequency components) of the error signal 490 impact the perceptual quality of a synthesized speech signal equally. Error in some frequency bands has a larger impact on the speech quality than error in other frequency bands. The perceptual weighting filter and error minimization module 492 may produce a weighted error signal 493 that reduces error in frequency components with a greater impact on speech quality and distributes more error in other frequency components with a lesser impact on speech quality.

The excitation estimation module 494 generates an excitation signal 496 and an encoded excitation signal 498 based on the output of the perceptual weighting filter and error minimization module 492. For example, the excitation estimation module 494 estimates one or more parameters that characterize the error signal 490 (e.g., the weighted error signal 493). The encoded excitation signal 498 may include the one or more parameters and may be sent to a decoder. In a CELP approach, for example, the excitation estimation module 494 may determine parameters such as an adaptive (or pitch) codebook index, an adaptive (or pitch) codebook gain, a fixed codebook index and a fixed codebook gain that characterize the error signal 490 (e.g., the weighted error signal 493). Based on these parameters, the excitation estimation module 494 may generate the excitation signal 496, which is provided to the synthesis filter 484. In this approach, the adaptive codebook index, the adaptive codebook gain (e.g., a quantized adaptive codebook gain), a fixed codebook index and a fixed codebook gain (e.g., a quantized fixed codebook gain) may be sent to a decoder as the encoded excitation signal 498.

The encoded excitation signal 498 may be an example of the encoded excitation signal 226 described above in connection with FIG. 2. Accordingly, the quantized weighting vector 441, the quantized LSF vector 482, the encoded excitation signal 498 and/or the prediction mode indicator 481 may be included in an encoded speech signal 106 as described above in connection with FIG. 1.

Figure 5:
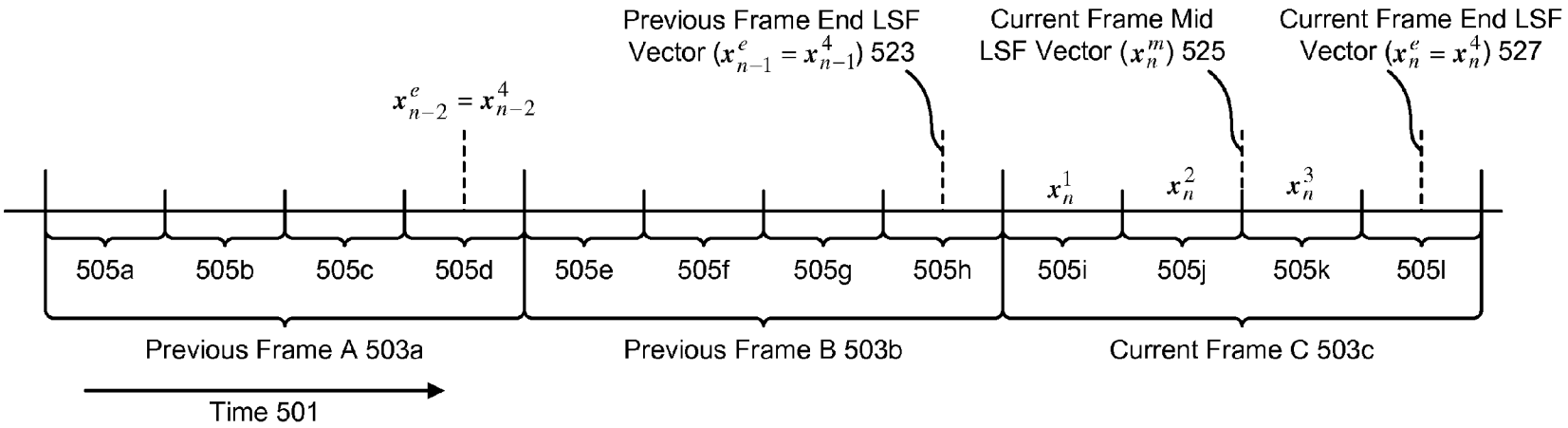
FIG. 5 is a diagram illustrating an example of frames over time.

FIG. 5 is a diagram illustrating an example of frames 503 over time 501. Each frame 503 is divided into a number of subframes 505. In the example illustrated in FIG. 5, previous frame A 503*a* includes 4 subframes 505*a-d*, previous frame B 503*b* includes 4 subframes 505*e-h* and current frame C 503*c* includes 4 subframes 505*i*-1. A typical frame 503 may occupy a time period of 20 ms and may include 4 subframes, though frames of different lengths and/or different numbers of subframes may be used. Each frame may be denoted with a corresponding frame number, where n denotes a current frame (e.g., current frame C 503*c*). Furthermore, each subframe may be denoted with a corresponding subframe number k.

FIG. 5 can be used to illustrate one example of LSF quantization in an encoder. Each subframe k in frame n has a corresponding LSF vector $x_n^k$, k={1, 2, 3, 4} for use in the analysis and synthesis filters. A current frame end LSF vector 527 (e.g., the last subframe LSF vector of the n-th frame) is denoted $x_n^e$, where $x_n^e=x_n^4$. A current frame mid LSF vector 525 (e.g., the mid LSF vector of the n-th frame) is denoted $x_n^m$. A "mid LSF vector" is an LSF vector between other LSF vectors (e.g., between $x_{n-1}^e$ and $x_n^e$) in time 501. One example of a previous frame end LSF vector 523 is illustrated in FIG. 5 and is denoted $x_{n-1}^e$, where $x_{n-1}^e=x_{n-1}^4$. As used herein, the term "previous frame" may refer to any frame before a current frame (e.g., n−1, n−2, n−3, etc.). Accordingly, a "previous frame end LSF vector" may be an end LSF vector corresponding to any frame before the current frame. In the example illustrated in FIG. 5, the previous frame end LSF vector 523 corresponds to the last subframe 505*h* of previous frame B 503*b* (e.g., frame n−1), which immediately precedes current frame C 503*c* (e.g., frame n).

Each LSF vector is M dimensional, where each dimension of the LSF vector corresponds to a single LSF dimension or value. For example, M is typically 16 for wideband speech (e.g., speech sampled at 16 kHz). The i-th LSF dimension of the k-th subframe of frame n is denoted as $x_{i,n}^k$, where i={1, 2, . . . , M}.

In the quantization process of frame n, the end LSF vector $x_n^e$ may be quantized first. This quantization can either be non-predictive (e.g., no previous LSF vector $x_{n-1}^e$ is used in the quantization process) or predictive (e.g., the previous LSF vector $x_{n-1}^e$ is used in the quantization process). A mid LSF vector $x_n^m$ may then be quantized. For example, an encoder may select a weighting vector such that $x_{i,n}^m$ is as provided in Equation (1).

$$x_{i,n}^m = w_{i,n} \cdot x_{i,n}^e + (1 - w_{i,n}) \cdot x_{i,n-1}^e \quad (1)$$

The i-th dimension of the weighting vector $w_n$ corresponds to a single weight and is denoted by $w_{i,n}$, where $i=\{1, 2, \ldots, M\}$. It should also be noted that $w_{i,n}$ is not constrained. In particular, if $0 \le w_{i,n} \le 1$ yields a value bounded by $x_{i,n}^e$ and $x_{i,n-1}^e$ and $w_{i,n}<0$ or $w_{i,n}>1$, the resulting mid LSF vector $x_n^m$ might be outside the range $[x_{i,n}^e\ x_{i,n-1}^e]$. An encoder may determine (e.g., select) a weighting vector $w_n$ such that the quantized mid LSF vector is closest to the actual mid LSF vector in the encoder based on some distortion measure, such as mean squared error (MSE) or log spectral distortion (LSD). In the quantization process, the encoder transmits the quantization indices of the end LSF vector $x_n^e$ and the index of the weighting vector $w_n$, which enables a decoder to reconstruct $x_n^e$ and $x_n^m$.

The subframe LSF vectors $x_n^k$ are interpolated based on $x_{i,n-1}^e$, $x_{i,n}^m$ and $x_{i,n}^e$ using interpolation factors $\alpha_k$ and $\beta_k$ as given by Equation (2).

$$x_n^k = \alpha_k \cdot x_n^e + \cdot \beta_k \cdot x_{n-1}^e + (1 - \alpha_k - \beta_k) \cdot x_n^m \quad (2)$$

It should be noted that $\alpha_k$ and $\beta_k$ are such that $0 \le (\alpha_k, \beta_k) \le 1$. The interpolation factors $\alpha_k$ and $\beta_k$ may be predetermined values known to both the encoder and decoder.

Figure 6:
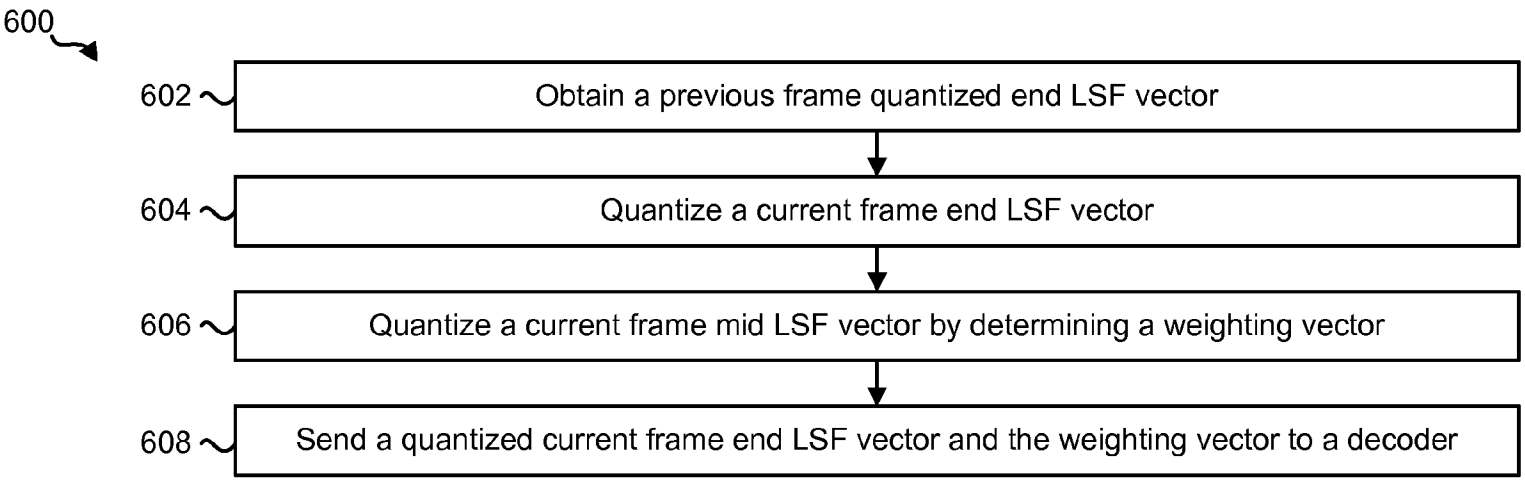
FIG. 6 is a flow diagram illustrating one configuration of a method for encoding a speech signal by an encoder.

FIG. 6 is a flow diagram illustrating one configuration of a method 600 for encoding a speech signal by an encoder 404. For example, an electronic device including an encoder 404 may perform the method 600. FIG. 6 illustrates LSF quantizing procedures for a current frame n.

The encoder 404 may obtain 602 a previous frame quantized end LSF vector. For example, the encoder 404 may quantize an end LSF vector corresponding to a previous frame (e.g., $x_{n-1}^e$) by selecting a codebook vector that is closest to the end LSF vector corresponding to the previous frame n−1.

The encoder 404 may quantize 604 a current frame end LSF vector (e.g., $x_n^e$). The encoder 404 quantizes 604 the current frame end LSF vector based on the previous frame end LSF vector if predictive LSF quantization is used. However, quantizing 604 the current frame LSF vector is not based on the previous frame end LSF vector if non-predictive quantization is used for the current frame end LSF vector.

The encoder 404 may quantize 606 a current frame mid LSF vector (e.g., $x_n^m$) by determining a weighting vector (e.g., $w_n$). For example, the encoder 404 may select a weighting vector that results in a quantized mid LSF vector that is closest to the actual mid LSF vector. As illustrated in Equation (1), the quantized mid LSF vector may be based on the weighting vector, the previous frame end LSF vector and the current frame end LSF vector.

The encoder 404 may send 608 a quantized current frame end LSF vector and the weighting vector to a decoder. For example, the encoder 404 may provide the current frame end LSF vector and the weighting vector to a transmitter on an electronic device, which may transmit them to a decoder on another electronic device.

Figure 7:
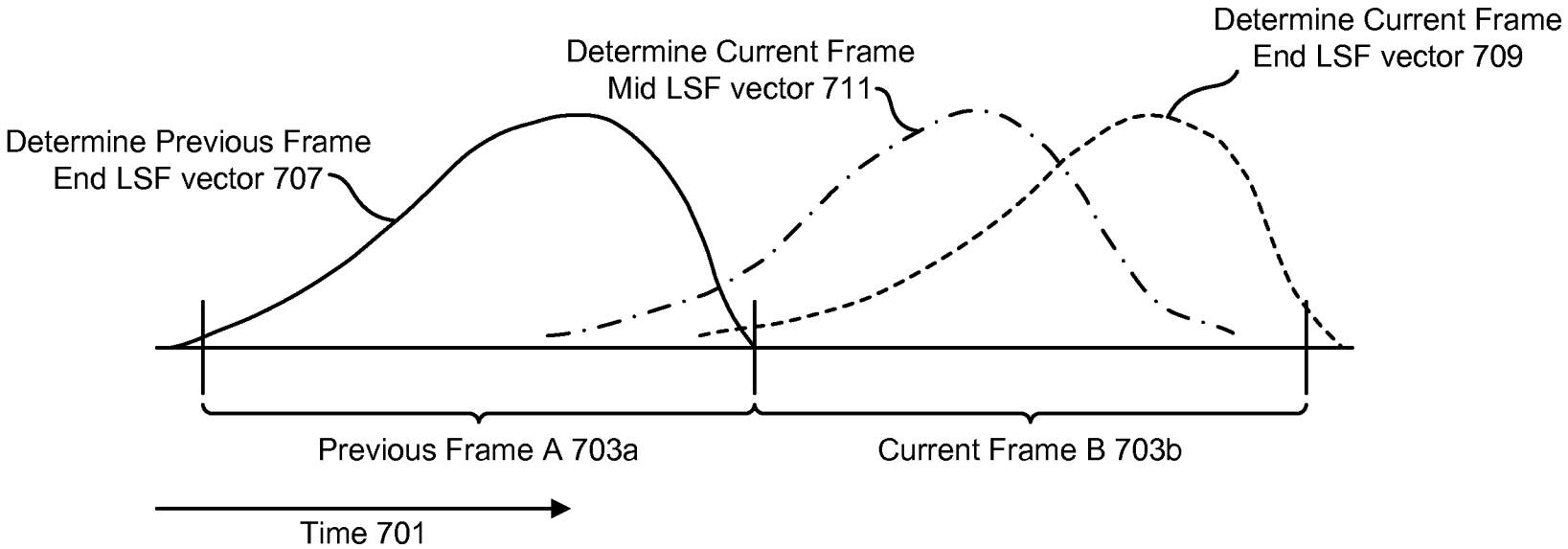
FIG. 7 is a diagram illustrating an example of line spectral frequency (LSF) vector determination.

FIG. 7 is a diagram illustrating an example of LSF vector determination. FIG. 7 illustrates previous frame A 703*a* (e.g., frame n−1) and current frame B 703*b* (e.g., frame n) over time 701. In this example, speech samples are weighted using weighting filters and are then used for LSF vector determination (e.g., computation). First, a weighting filter at the encoder 404 is used to determine 707 a previous frame end LSF vector (e.g., $x_{n-1}^e$). Second, a weighting filter at the encoder 404 is used to determine 709 a current frame end LSF vector (e.g., $x_n^e$). Third, a weighting filter at the encoder 404 is used to determine 711 (e.g., compute) a current frame mid LSF vector (e.g., $x_n^m$).

Figure 8:
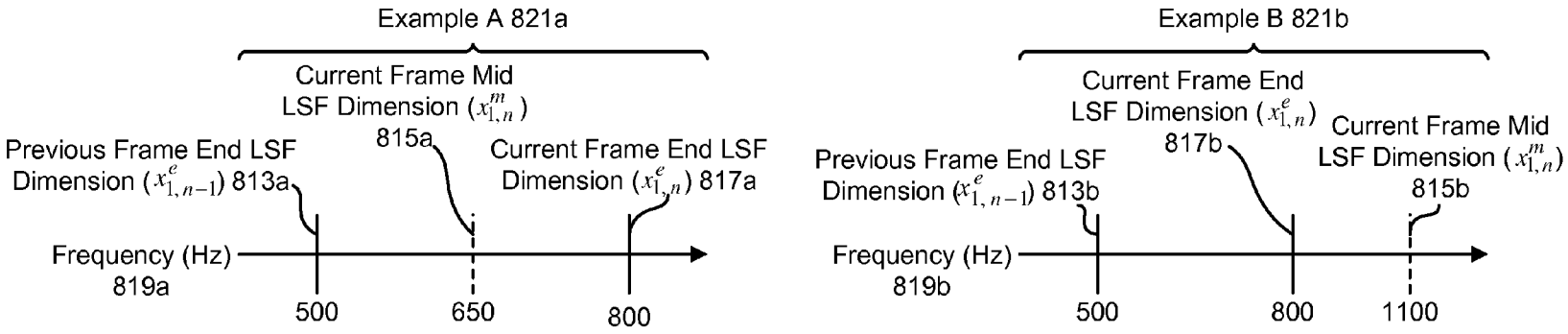
FIG. 8 includes two diagrams illustrating examples of LSF interpolation and extrapolation.

FIG. 8 includes two diagrams illustrating examples of LSF interpolation and extrapolation. The horizontal axis in example A 821*a* illustrates frequency in Hz 819*a* and the horizontal axis in example B 821*b* also illustrates frequency in Hz 819*b*. In particular, several LSF dimensions are represented in the frequency domain in FIG. 8. However, it should be noted that there are multiple ways of representing an LSF dimension (e.g., frequency, angle, value, etc.). Accordingly, the horizontal axes 819*a-b* in example A 821*a* and example B 821*b* could be described in terms of other units.

Example A 821*a* illustrates an interpolation case that considers a first dimension of an LSF vector. As described above, an LSF dimension refers to a single LSF dimension or value of an LSF vector. Specifically, example A 821*a* illustrates a previous frame end LSF dimension 813*a* (e.g., $x_{1,n-1}^e$) at 500 Hz and a current frame end LSF dimension (e.g., $x_{1,n}^e$) 817*a* at 800 Hz. In example A 821*a*, a first weight (e.g., a first dimension of a weighting vector $w_n$ or $w_{1,n}$) may be used to quantize and indicate a mid LSF dimension (e.g., $x_{1,n}^m$) 815*a* of a current frame mid LSF vector between the previous frame end LSF dimension (e.g., $x_{1,n-1}^e$) 813*a* and the current frame end LSF dimension (e.g., $x_{1,n}^e$) 817*a* in frequency 819*a*. For instance, if $w_{1,n}=0.5$, $x_{1,n}^e=800$ and $x_{1,n-1}^e=500$, then $x_{1,n}^m = w_{1,n} \cdot x_{1,n}^e + (1 - w_{1,n}) \cdot x_{1,n-1}^e = 650$ as illustrated in example A 821*a*.

Example B 821*b* illustrates an extrapolation case that considers a first LSF dimension of an LSF vector. Specifically, example B 821*b* illustrates a previous frame end LSF dimension (e.g., $x_{1,n-1}^e$) 813*b* at 500 Hz and a current frame end LSF dimension (e.g., $x_{1,n}^e$) 817*b* at 800 Hz. In example B 821*b*, a first weight (e.g., a first dimension of a weighting vector $w_n$ or $w_{1,n}$) may be used to quantize and indicate a mid LSF dimension (e.g., $x_{1,n}^m$) 815*b* of a current frame mid LSF vector that does not lie between the previous frame end LSF dimension (e.g., $x_{1,n-1}^e$) 813*b* and the current frame end LSF dimension (e.g., $x_{1,n}^e$) 817*b* in frequency 819*b*. As illustrated in example B 821*b*, for instance, if $w_{1,n}=2$, $x_{1,n}^e=800$ and $x_{1,n-1}^e=500$, then $x_{1,n}^m = [2 * x_{1,n}^e] + [(1-2) * x_{1,n-1}^e] \Rightarrow 2 \cdot 800 + (-1) \cdot 500 = 1100$.

Figure 9:
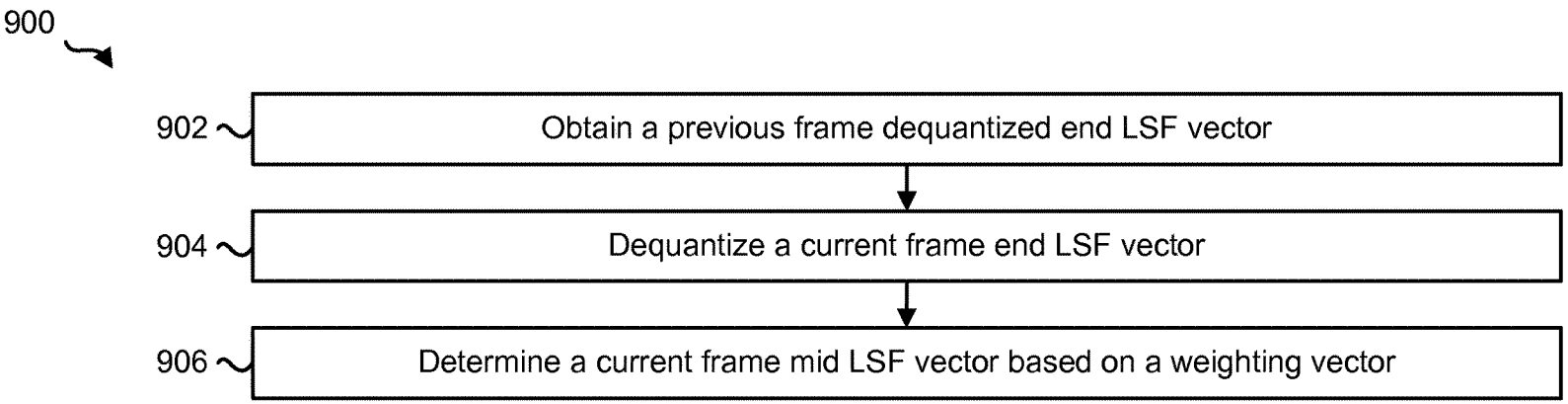
FIG. 9 is a flow diagram illustrating one configuration of a method for decoding an encoded speech signal by a decoder.

FIG. 9 is a flow diagram illustrating one configuration of a method 900 for decoding an encoded speech signal by a decoder. For example, an electronic device including a decoder may perform the method 900.

The decoder may obtain 902 a previous frame dequantized end LSF vector (e.g., $x_{n-1}^e$) For example, the decoder may retrieve a dequantized end LSF vector corresponding to a previous frame that has been previously decoded (or estimated, in the case of a frame erasure).

The decoder may dequantize 904 a current frame end LSF vector (e.g., $x_n^e$). For example, the decoder may dequantize 904 the current frame end LSF vector by looking up the current frame LSF vector in a codebook or table based on a received LSF vector index.

The decoder may determine 906 a current frame mid LSF vector (e.g., $x_n^m$) based on a weighting vector (e.g., $w_n$). For example, the decoder may receive the weighting vector from an encoder. The decoder may then determine 906 the current frame mid LSF vector based on the previous frame end LSF vector, the current frame end LSF vector and the weighting vector as illustrated in Equation (1). As described above, each LSF vector may have M dimensions or LSF dimensions (e.g., 16 LSF dimensions). There should be a minimum separation between two or more of the LSF dimensions in the LSF vector in order for the LSF vector to be stable. However, if there are multiple LSF dimensions clustered with only the minimum separation, then there is a substantial likelihood of an unstable LSF vector. As described above, the decoder may reorder the LSF vector in cases where there is less than the minimum separation between two or more of the LSF dimensions in the LSF vector.

The approach described in connection with FIGS. 4-9 for weighting and interpolation and/or extrapolation of LSF vectors operates well under clean channel conditions (without frame erasures and/or transmission errors). However, this approach may have some serious issues when one or more frame erasures occur. An erased frame is a frame that is not received or that is incorrectly received with errors by a decoder. For example, a frame is an erased frame if an encoded speech signal corresponding to the frame is not received or is incorrectly received with errors.

An example of frame erasure is given hereafter with reference to FIG. 5. Assume that previous frame B 503*b* is an erased frame (e.g., frame n−1 is lost). In this instance, a decoder estimates the lost end LSF vector (denoted $\hat{x}_{n-1}^{e}$) and mid LSF vector (denoted $\hat{x}_{n-1}^{m}$) based on previous frame A 503*a* (e.g., frame n−2). Also assume that frame n is correctly received. The decoder may use Equation (1) to compute the current frame mid LSF vector 525 based on $\hat{x}_{n-1}^{e}$ and $x_{i,n}^{e}$. In a case where a particular LSF dimension j (e.g., dimension j) of $x_n^m$ is extrapolated, there is a possibility that the LSF dimension is placed well outside the LSF dimension frequencies used in the extrapolation process (e.g., $x_{i,n}^{m}>\max(x_{i,n-1}^{e}, x_{i,n}^{e})$) in the encoder.

The LSF dimensions in each LSF vector may be ordered such that $x_{1,n}^{m}+\Delta\leq x_{2,n}^{m}+\Delta\leq \ldots \leq x_{M,n}^{m}$, where Δ is a minimum separation (e.g., frequency separation) between two consecutive LSF dimensions. As described above, if a certain LSF dimension j (e.g., denoted $x_{j,n}^{m}$), is extrapolated erroneously such that it is significantly larger than the correct value, the subsequent LSF dimensions $x_{j+1,n}^{m}$, $x_{j+2,n}^{m}$, . . . may be recomputed as $x_{j,n}^{m}+\Delta$, $x_{j,n}^{m}+2\Delta$, . . . , even though they are computed as $x_{j+1,n}^{m}, x_{j+2,n}^{m}, \ldots < x_{j,n}^{m}$ in the decoder. For example, although the recomputed LSF dimensions j, j+1, etc., may be smaller than the LSF dimension j, they may be recomputed to be $x_{j,n}^{m}+\Delta$, $x_{j,n}^{m}+2\Delta$, . . . due to the imposed ordering structure. This creates an LSF vector that has two or more LSF dimensions placed next to each other with the minimum allowed distance. Two or more LSF dimensions separated by only the minimum separation may be referred to as "clustered LSF dimensions." The clustered LSF dimensions may result in unstable LSF dimensions (e.g., unstable subframe LSF dimensions) and/or unstable LSF vectors. Unstable LSF dimensions correspond to coefficients of a synthesis filter that can result in a speech artifact.

In a strict sense, a filter may be unstable if it has at least one pole on or outside the unit circle. In the context of speech coding and as used herein, the terms "unstable" and "instability" are used in a broader sense. For example, an "unstable LSF dimension" is any LSF dimension corresponding to a coefficient of a synthesis filter that can result in a speech artifact. For example, unstable LSF dimensions may not necessarily correspond to poles on or outside of the unit circle, but may be "unstable" if their values are too close to each other. This is because LSF dimensions that are placed too close to each other may specify poles in a synthesis filter that has highly resonant filter responses in some frequencies that produce speech artifacts. For instance, an unstable quantized LSF dimension may specify a pole placement for a synthesis filter that can result in an undesired energy increase. Typically, LSF dimension separation may be maintained around 0.01*π for LSF dimensions represented in terms of angles between 0 and π. As used herein, an "unstable LSF vector" is a vector that includes one or more unstable LSF dimensions. Furthermore, an "unstable synthesis filter" is a synthesis filter with one or more coefficients (e.g., poles) corresponding to one or more unstable LSF dimensions.

Figure 10:
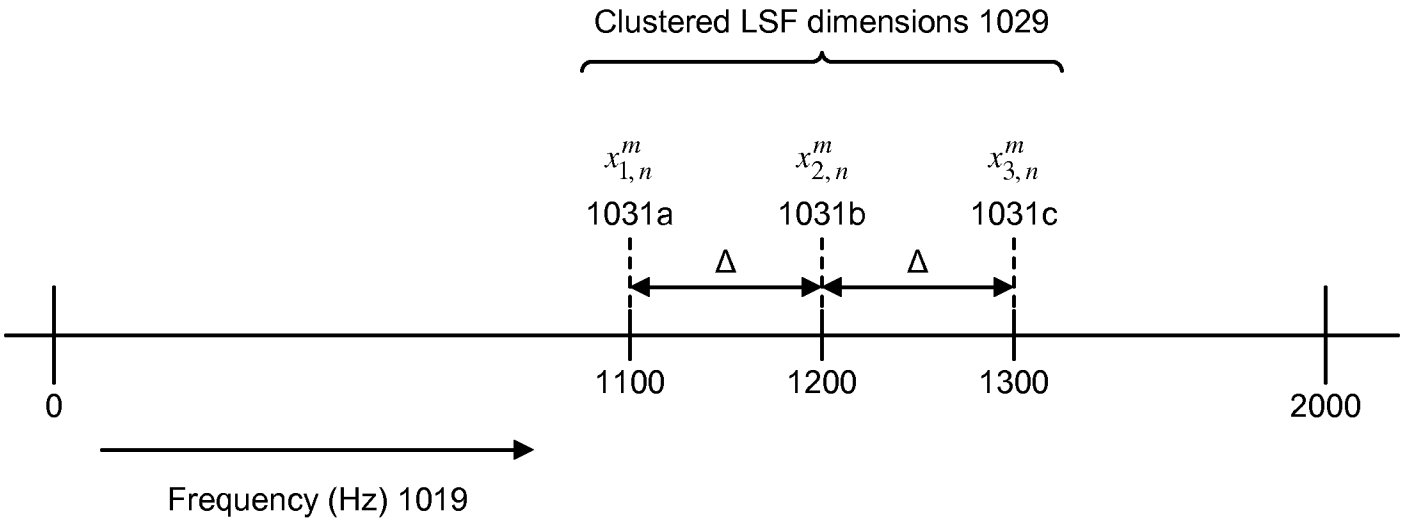
FIG. 10 is a diagram illustrating one example of clustered LSF dimensions.

FIG. 10 is a diagram illustrating one example of clustered LSF dimensions 1029. The LSF dimensions are illustrated in frequency 1019 in Hz, though it should be noted that the LSF dimensions could be alternatively characterized in other units. The LSF dimensions (e.g., $x_{1,n}^{m}$, 1031*a*, $x_{2,n}^{m}$ 1031*b* and $x_{3,n}^{m}$ 1031*c*) are examples of LSF dimensions included in a current frame mid LSF vector after estimation and reordering. In a previous erased frame, for example, a decoder estimates the first LSF dimension of the previous frame end LSF vector (e.g., $x_{1,n-1}^{e}$), which is likely incorrect. In this case, the first LSF dimension of the current frame mid LSF vector (e.g., $x_{1,n}^{m}$ 1031*a*) is also likely incorrect.

The decoder may attempt to reorder the next LSF dimension of the current frame mid LSF vector (e.g., $x_{2,n}^{m}$ 1031*b*). As described above, each successive LSF dimension in an LSF vector may be required to be greater than the previous element. For example, $x_{2,n}^{m}$ 1031*b* must be greater than $x_{1,n}^{m}$, 1031*a*. Thus, a decoder may place it with a minimum separation (e.g., Δ) from $x_{1,n}^{m}$ 1031*a*. More specifically, $x_{2,n}^{m}=x_{1,n}^{m}+\Delta$. Accordingly, there may be multiple LSF dimensions (e.g., $x_{1,n}^{m}$, 1031*a*, $x_{2,n}^{m}$ 1031*b* and $x_{3,n}^{m}$ 1031*c*) with the minimum separation (e.g., Δ=100 Hz), as illustrated in FIG. 10. Thus, $x_{1,n}^{m}$ 1031*a*, $x_{2,n}^{m}$ 1031*b* and $x_{3,n}^{m}$ 1031*c* are an example of clustered LSF dimensions 1029. Clustered LSF dimensions may result in an unstable synthesis filter, which in turn may produce speech artifacts in the synthesized speech.

Figure 11:
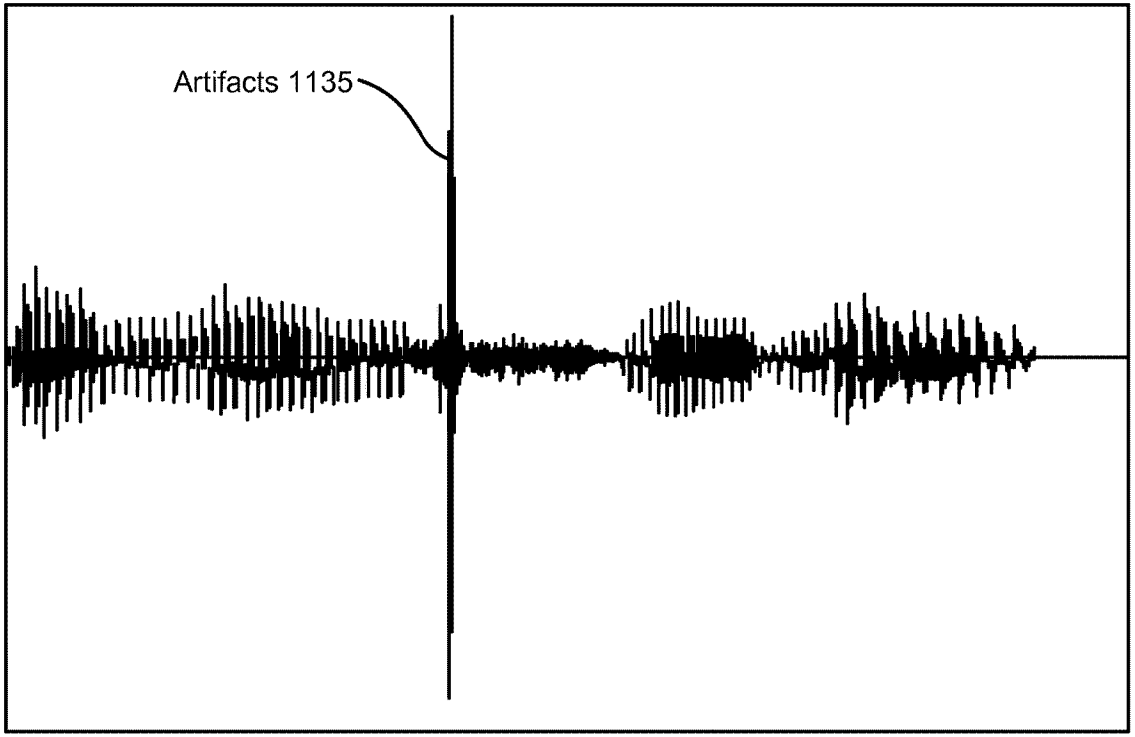
FIG. 11 is a graph illustrating an example of artifacts due to clustered LSF dimensions.

FIG. 11 is a graph illustrating an example of artifacts 1135 due to clustered LSF dimensions. More specifically, the graph illustrates an example of artifacts 1135 in a decoded speech signal (e.g., synthesized speech) that result from clustered LSF dimensions being applied to a synthesis filter. The horizontal axis of the graph is illustrated in time 1101 (e.g., seconds) and the vertical axis of the graph is illustrated in amplitude 1133 (e.g., a number, a value). The amplitude 1133 may be a number represented in bits. In some configurations, 16 bits may be utilized to represent samples of a speech signal ranging in value between −32768 to 32767, which corresponds to a range (e.g., a value between −1 and +1 in floating point). It should be noted that the amplitude 1133 may be represented differently based on the implementation. In some examples, the value of the amplitude 1133 may correspond to an electromagnetic signal characterized by voltage (in volts) and/or current (in amps).

Interpolation and/or extrapolation of LSF vectors between current and previous frame LSF vectors on a subframe basis are known in speech coding systems. Under erased frame conditions as described in connection with FIGS. 10 and 11, LSF interpolation and/or extrapolation schemes can generate unstable LSF vectors for certain subframes, which can result in annoying artifacts in the synthesized speech. The artifacts occur more frequently when predictive quantization techniques in addition to non-predictive techniques are used for LSF quantization.

Using an increased number of bits for error protection and using non-predictive quantization to avoid error propagation are common ways to address the issue. However, introduction of additional bits is not possible under bit constrained coders and use of non-predictive quantization may reduce the speech quality in clean channel conditions (without erased frames, for example).

The systems and methods disclosed herein may be utilized for mitigating potential frame instability. For instance, some configurations of the systems and methods disclosed herein may be applied to mitigate the speech coding artifacts due to frame instability resulting from predictive quantization and inter-frame interpolation and extrapolation of LSF vectors under an impaired channel.

Figure 12:
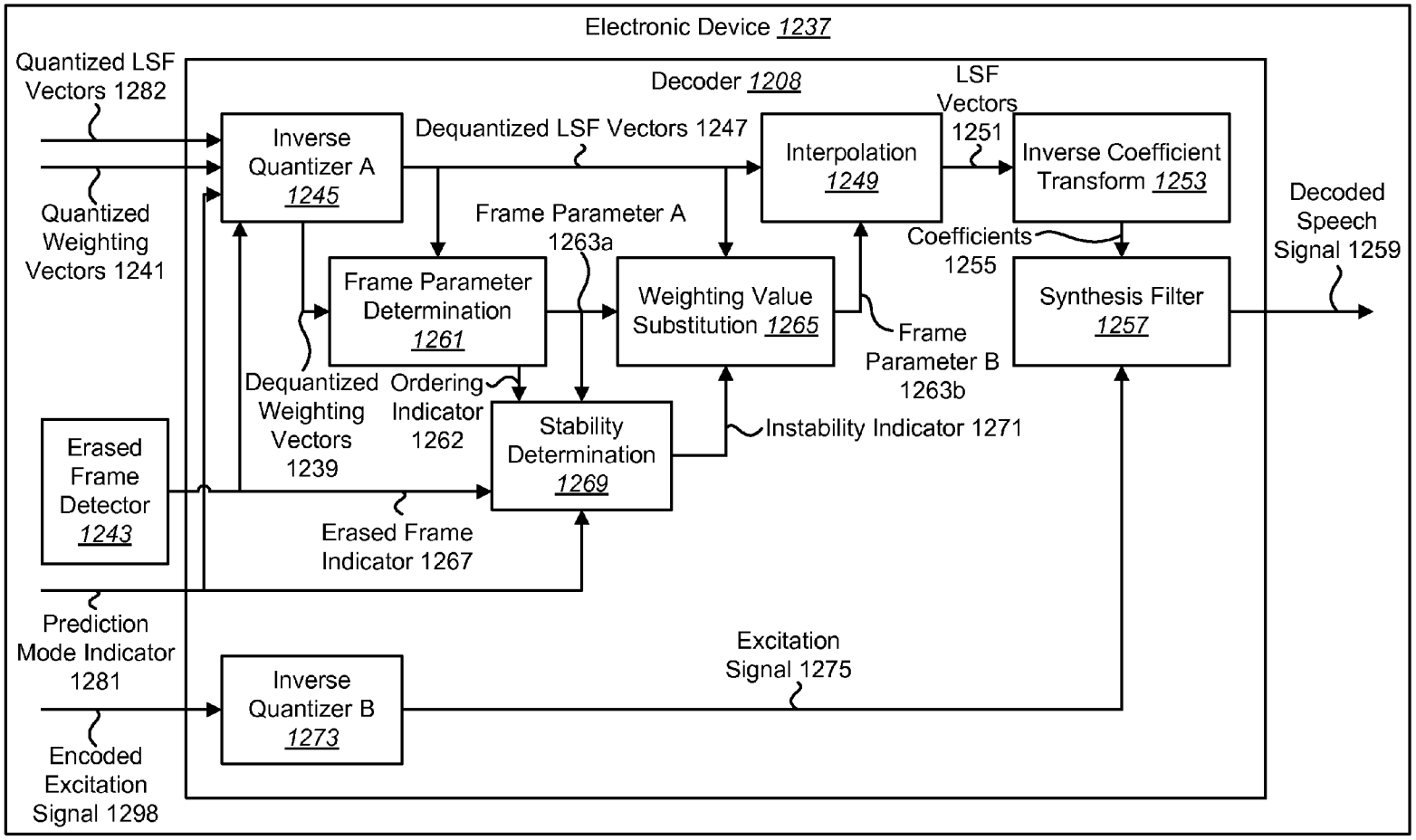
FIG. 12 is a block diagram illustrating one configuration of an electronic device configured for mitigating potential frame instability.

FIG. 12 is a block diagram illustrating one configuration of an electronic device 1237 configured for mitigating potential frame instability. The electronic device 1237 includes a decoder 1208. One or more of the decoders described above may be implemented in accordance with the decoder 1208 described in connection with FIG. 12. The electronic device 1237 also includes an erased frame detector 1243. The erased frame detector 1243 may be implemented separately from the decoder 1208 or may be implemented in the decoder 1208. The erased frame detector 1243 detects an erased frame (e.g., a frame that is not received or is received with errors) and may provide an erased frame indicator 1267 when an erased frame is detected. For example, the erased frame detector 1243 may detect an erased frame based on one or more of a hash function, checksum, repetition code, parity bit(s), cyclic redundancy check (CRC), etc. It should be noted that one or more of the components included in the electronic device 1237 and/or decoder 1208 may be implemented in hardware (e.g., circuitry), software or a combination of both. One or more of the lines or arrows illustrated in block diagrams herein may indicate couplings (e.g., connections) between components or elements.

The decoder 1208 produces a decoded speech signal 1259 (e.g., a synthesized speech signal) based on received parameters. Examples of the received parameters include quantized LSF vectors 1282, quantized weighting vectors 1241, a prediction mode indicator 1281 and an encoded excitation signal 1298. The decoder 1208 includes one or more of inverse quantizer A 1245, an interpolation module 1249, an inverse coefficient transform 1253, a synthesis filter 1257, a frame parameter determination module 1261, a weighting value substitution module 1265, a stability determination module 1269 and inverse quantizer B 1273.

The decoder 1208 receives quantized LSF vectors 1282 (e.g., quantized LSFs, LSPs, ISFs, ISPs, PARCOR coefficients, reflection coefficients or log-area-ratio values) and quantized weighting vectors 1241. The received quantized LSF vectors 1282 may correspond to a subset of subframes. For example, the quantized LSF vectors 1282 may only include quantized end LSF vectors that correspond to the last subframe of each frame. In some configurations, the quantized LSF vectors 1282 may be indices corresponding to a look up table or codebook. Additionally or alternatively, the quantized weighting vectors 1241 may be indices corresponding to a look up table or codebook.

The electronic device 1237 and/or the decoder 1208 may receive the prediction mode indicator 1281 from an encoder. As described above, the prediction mode indicator 1281 indicates a prediction mode for each frame. For example, the prediction mode indicator 1281 may indicate one of two or more prediction modes for a frame. More specifically, the prediction mode indicator 1281 may indicate whether predictive quantization or non-predictive quantization is utilized.

When a frame is correctly received, inverse quantizer A 1245 dequantizes the received quantized LSF vectors 1282 to produce dequantized LSF vectors 1247. For example, inverse quantizer A 1245 may look up dequantized LSF vectors 1247 based on indices (e.g., the quantized LSF vectors 1282) corresponding to a look up table or codebook. Dequantizing the quantized LSF vectors 1282 may also be based on the prediction mode indicator 1281. The dequantized LSF vectors 1247 may correspond to a subset of subframes (e.g., end LSF vectors $x_n^e$ corresponding to the last subframe of each frame). Furthermore, inverse quantizer A 1245 dequantizes the quantized weighting vectors 1241 to produce dequantized weighting vectors 1239. For example, inverse quantizer A 1245 may look up dequantized weighting vectors 1239 based on indices (e.g., the quantized weighting vectors 1241) corresponding to a look up table or codebook.

When a frame is an erased frame, the erased frame detector 1243 may provide an erased frame indicator 1267 to inverse quantizer A 1245. When an erased frame occurs, one or more quantized LSF vectors 1282 and/or one or more quantized weighting vectors 1241 may not be received or may contain errors. In this case, inverse quantizer A 1245 may estimate one or more dequantized LSF vectors 1247 (e.g., an end LSF vector of the erased frame $\hat{x}_n^e$) based on one or more LSF vectors from a previous frame (e.g., a frame before the erased frame). Additionally or alternatively, inverse quantizer A 1245 may estimate one or more dequantized weighting vectors 1239 when an erased frame occurs.

The dequantized LSF vectors 1247 (e.g., end LSF vectors) may be provided to the frame parameter determination module 1261 and to the interpolation module 1249. Furthermore, one or more dequantized weighting vectors 1239 may be provided to the frame parameter determination module 1261. The frame parameter determination module 1261 obtains frames. For example, the frame parameter determination module 1261 may obtain an erased frame (e.g., an estimated dequantized weighting vector 1239 and an estimated dequantized LSF vector 1247 corresponding to an erased frame). The frame parameter determination module 1261 may also obtain a frame (e.g., a correctly received frame) after an erased frame. For instance, the frame parameter determination module 1261 may obtain a dequantized weighting vector 1239 and a dequantized LSF vector 1247 corresponding to a correctly received frame after an erased frame.

The frame parameter determination module 1261 determines frame parameter A **1263*a* based on the dequantized LSF vectors 1247 and a dequantized weighting vector 1239. One example of frame parameter A 1263*a* is a mid LSF vector (e.g., $x_n^m$). For example, the frame parameter determination module may apply a received weighting vector (e.g., a dequantized weighting vector 1239) to generate a current frame mid LSF vector. For instance, the frame parameter determination module 1261 may determine a current frame mid LSF vector $x_n^m$ based on a current frame end LSF vector $x_n^e$, a previous frame end LSF vector $x_{n-1}^e$ and a current frame weighting vector $w_n$ in accordance with Equation (1). Other examples of frame parameter A 1263*a* include LSP vectors and ISP vectors. For instance, frame parameter A 1263*a*** may be any parameter that is estimated based on two end subframe parameters.

In some configurations, the frame parameter determination module 1261 may determine whether a frame parameter (e.g., a current frame mid LSF vector $x_n^m$) is ordered in accordance with a rule before any reordering. In one example, this frame parameter is a current frame mid LSF vector $x_n^m$ and the rule may be that each LSF dimension in the mid LSF vector $x_n^m$ is in increasing order with at least a minimum separation between each LSF dimension pair. In this example, the frame parameter determination module 1261 may determine whether each LSF dimension in the mid LSF vector $x_n^m$ is in increasing order with at least a minimum separation between each LSF dimension pair. For instance, the frame parameter determination module 1261 may determine whether $x_{1,n}^m+\Delta \leq x_{2,n}^m+\Delta \leq \ldots \leq x_{M,n}^m$ is true.

In some configurations, the frame parameter determination module 1261 may provide an ordering indicator 1262 to the stability determination module 1269. The ordering indicator 1262 indicates whether the LSF dimensions (in the mid LSF vector $x_n^m$, for example) were out of order and/or were not separated by more than the minimum separation Δ before any reordering.

The frame parameter determination module 1261 may reorder an LSF vector in some cases. For example, if the frame parameter determination module 1261 determines that the LSF dimensions included in a current frame mid LSF vector $x_n^m$ are not in increasing order and/or these LSF dimensions do not have at least a minimum separation between each LSF dimension pair, the frame parameter determination module 1261 may reorder the LSF dimensions. For instance, the frame parameter determination module 1261 may reorder the LSF dimensions in the current frame mid LSF vector $x_n^m$ such that $x_{j+1,n}^m=x_{j,n}^m+\Delta$ for each LSF dimension that does not meet the criteria $x_{j,n}^m+\Delta<x_{j+1,n}^m$. In other words, the frame parameter determination module 1261 may add Δ to an LSF dimension to obtain a position for the next LSF dimension, if the next LSF dimension was not separated at least by Δ. Furthermore, this may only be done for LSF dimensions that are not separated by the minimum separation Δ. As described above, this reordering may result in clustered LSF dimensions in the mid LSF vector $x_n^m$. Accordingly, frame parameter A 1263*a* may be a reordered LSF vector (e.g., mid LSF vector $x_n^m$) in some cases (e.g., for one or more frames after an erased frame).

In some configurations, the frame parameter determination module 1261 may be implemented as part of inverse quantizer A 1245. For example, determining a mid LSF vector based on the dequantized LSF vectors 1247 and a dequantized weighting vector 1239 may be considered part of a dequantizing procedure. Frame parameter A 1263*a* may be provided to the weighting value substitution module 1265 and optionally to the stability determination module 1269.

The stability determination module 1269 may determine whether a frame is potentially unstable. The stability determination module 1269 may provide an instability indicator 1271 to the weighting value substitution module 1265 when the stability determination module 1269 determines that the current frame is potentially unstable. In other words, the instability indicator 1271 indicates that the current frame is potentially unstable.

A potentially unstable frame is a frame with one or more characteristics that indicate a risk of producing a speech artifact. Examples of characteristics that indicate a risk of producing a speech artifact may include when a frame is within one or more frames after an erased frame, whether any frame between the frame and an erased frame utilizes predictive (or non-predictive) quantization and/or whether a frame parameter is ordered in accordance with a rule before any reordering. A potentially unstable frame may correspond to (e.g., may include) one or more unstable LSF vectors. It should be noted that a potentially unstable frame may be actually stable in some cases. However, it may be difficult to determine whether a frame is certainly stable or certainly unstable without synthesizing the entire frame. Accordingly, the systems and methods disclosed herein may take corrective action to mitigate potentially unstable frames. One benefit of the systems and methods disclosed herein is detecting potentially unstable frames without synthesizing the entire frame. This may reduce the amount of processing and/or latency required to detect and/or mitigate speech artifacts.

In a first approach, the stability determination module 1269 determines whether a current frame (e.g., frame n) is potentially unstable based on whether the current frame is within a threshold number of frames after an erased frame and whether any frame between an erased frame and the current frame utilizes predictive (or non-predictive) quantization. The current frame may be correctly received. In this approach, the stability determination module 1269 determines that a frame is potentially unstable if the current frame is received within a threshold number of frames after an erased frame and if no frame between the current frame and the erased frame (if any) utilizes non-predictive quantization.

The number of frames between the erased frame and the current frame may be determined based on the erased frame indicator 1267. For example, the stability determination module 1269 may maintain a counter that increments for each frame after an erased frame. In one configuration, the threshold number of frames after the erased frame may be 1. In this configuration, the next frame after an erased frame is always considered to be potentially unstable. For example, if the current frame is the next frame after an erased frame (hence, there is no frame that utilizes non-predictive quantization between the current frame and the erased frame), then the stability determination module 1269 determines that the current frame is potentially unstable. In this case, the stability determination module 1269 provides an instability indicator 1271 indicating that the current frame is potentially unstable.

In other configurations, the threshold number of frames after the erased frame may be greater than 1. In these configurations, the stability determination module 1269 may determine if there is a frame that utilizes non-predictive quantization between the current frame and the erased frame based on the prediction mode indicator 1281. For example, the prediction mode indicator 1281 may indicate whether predictive or non-predictive quantization is utilized for each frame. If there is a frame between the current frame and the erased frame that uses non-predictive quantization, the stability determination module 1269 may determine that the current frame is stable (e.g., not potentially unstable). In this case, the stability determination module 1269 may not indicate that the current frame is potentially unstable.

In a second approach, the stability determination module 1269 determines whether a current frame (e.g., frame n) is potentially unstable based on whether the current frame is received after an erased frame, whether frame parameter A 1263*a* was ordered in accordance with a rule before any reordering and whether any frame between an erased frame and the current frame utilizes non-predictive quantization. In this approach, the stability determination module 1269 determines that a frame is potentially unstable if the current frame is obtained after an erased frame, if frame parameter A 1263*a* was not ordered in accordance with a rule before any reordering and if no frame between the current frame and the erased frame (if any) utilizes non-predictive quantization.

Whether the current frame is received after the erased frame may be determined based on the erased frame indicator 1267. Whether any frame between an erased frame and the current frame utilizes non-predictive quantization may be determined based on the prediction mode indicator as described above. For example, if the current frame is any number of frames after an erased frame, if there is no frame that utilizes non-predictive quantization between the current frame and the erased frame and if frame parameter A 1263*a* was not ordered in accordance with a rule before any reordering, then the stability determination module 1269 determines that the current frame is potentially unstable. In this case, the stability determination module 1269 provides an instability indicator 1271 indicating that the current frame is potentially unstable.

In some configurations, the stability determination module 1269 may obtain the ordering indicator 1262 from the frame parameter determination module 1261, which indicates whether frame parameter A 1263*a* (e.g., a current frame mid LSF vector $x_n^m$) was ordered in accordance with a rule before any reordering. For example, the ordering indicator 1262 may indicate whether the LSF dimensions (in the mid LSF vector $x_n^m$, for example) were out of order and/or were not separated by at least the minimum separation Δ before any reordering.

A combination of the first and second approaches may be implemented in some configurations. For example, the first approach may be applied for the first frame after an erased frame, while the second approach may be applied for subsequent frames. In this configuration, one or more of the subsequent frames may be indicated as potentially unstable based on the second approach. Other approaches to determining potential instability may be based on energy variation of an impulse response of synthesis filters based on the LSF vectors and/or energy variations corresponding to different frequency bands of synthesis filters based on the LSF vectors.

When no potential instability is indicated (e.g., when the current frame is stable), the weighting value substitution module 1265 provides or passes frame parameter A 1263*a* as frame parameter B 1263 to the interpolation module 1249. In one example, frame parameter A 1263*a* is a current frame mid LSF vector $x_n^m$ that is based on a current frame end LSF vector $x_n^e$, a previous frame end LSF vector $x_{n-1}^e$ and a received current frame weighting vector $w_n$. When no potential instability is indicated, the current frame mid LSF vector $x_n^m$ may be assumed to be stable and may be provided to the interpolation module 1249.

If the current frame is potentially unstable, the weighting value substitution module 1265 applies a substitute weighting value to generate a stable frame parameter (e.g., a substitute current frame mid LSF vector $x_n^m$). A "stable frame parameter" is a parameter that will not cause speech artifacts. The substitute weighting value may be a predetermined value that ensures a stable frame parameter (e.g., frame parameter B 1263*b*). The substitute weighting value may be applied instead of a (received and/or estimated) dequantized weighting vector 1239. More specifically, the weighting value substitution module 1265 applies a substitute weighting value to the dequantized LSF vectors 1247 to generate a stable frame parameter B 1263*b* when the instability indicator 1271 indicates that the current frame is potentially unstable. In this case, frame parameter A 1263*a* and/or the current frame dequantized weighting vector 1239 may be discarded. Accordingly, the weighting value substitution module 1265 generates a frame parameter B 1263*b* that replaces frame parameter A 1263*a* when the current frame is potentially unstable.

For example, the weighting value substitution module 1265 may apply a substitute weighting value $w^{substitute}$ to generate a (stable) substitute current frame mid LSF vector $x_n^m$. For instance, the weighting value substitution module 1265 may apply the substitute weighting value to a current frame end LSF vector and a previous frame end LSF vector. In some configurations, the substitute weighting value $w^{substitute}$ may be a scalar value between 0 and 1. For example, the substitute weighting value $w^{substitute}$ may operate as a substitute weighting vector (with M dimensions, for example), where all values are equal to $w^{substitute}$, where $0 \le w^{substitute} \le 1$ (or $0 < w^{substitute} < 1$). Thus, a (stable) substitute current frame mid LSF vector $x_n^m$ may be generated or determined in accordance with Equation (3).

$$x_n^m = w^{substitute} \cdot x_n^e + (1 - w^{substitute}) \cdot x_{n-1}^e \tag{3}$$

Utilizing a $w^{substitute}$ between 0 and 1 ensures that the resulting substitute current frame mid LSF vector $x_n^m$ is stable if the underlying end LSF vectors $x_n^e$ and $x_{n-1}^e$ are stable. In this case, the substitute current frame mid LSF vector is one example of a stable frame parameter, since applying coefficients 1255 corresponding to the substitute current frame mid LSF vector to a synthesis filter 1257 will not cause speech artifacts in the decoded speech signal 1259. In some configurations, $w^{substitute}$ may be selected as 0.6, which gives slightly more weight to the current frame end LSF vector (e.g., $x_n^e$) compared to the previous frame end LSF vector (e.g., $x_{n-1}^e$) corresponding to the erased frame.

In alternative configurations, the substitute weighting value may be a substitute weighting vector $w^{substitute}$ including individual weights $w_{i,n}^{substitute}$, where $i=\{1, 2, \ldots, M\}$ and n denotes the current frame. In these configurations, each weight $w_{i,n}^{substitute}$ is between 0 and 1 and all weights may not be the same. In these configurations, the substitute weighting value (e.g., substitute weighting vector $w^{substitute}$) may be applied as provided in Equation (4).

$$x_{i,n}^m = w_{i,n}^{substitute} \cdot x_{i,n}^e + (1 - w_{i,n}^{substitute}) \cdot x_{i,n-1}^e \tag{4}$$

In some configurations, the substitute weighting value may be static. In other configurations, the weighting value substitution module 1265 may select a substitute weighting value based on the previous frame and the current frame. For example, different substitute weighting values may be selected based on the classification (e.g., voiced, unvoiced, etc.) of two frames (e.g., the previous frame and the current frame). Additionally or alternatively, different substitute weighting values may be selected based on one or more LSF differences between two frames (e.g., difference in LSF filter impulse response energies).

The dequantized LSF vectors 1247 and frame parameter B 1263*b* may be provided to the interpolation module 1249. The interpolation module 1249 interpolates the dequantized LSF vectors 1247 and frame parameter B 1263*b* in order to generate subframe LSF vectors (e.g., subframe LSF vectors $x_n^k$ for the current frame).

In one example, frame parameter B 1263 is a current frame mid LSF vector $x_n^m$ and the dequantized LSF vectors 1247 include the previous frame end LSF vector $x_{n-1}^e$ and the current frame end LSF vector $x_n^e$. For instance, the interpolation module 1249 may interpolate the subframe LSF vectors $x_n^k$ based on $x_{i,n-1}^e$, $x_{i,n}^m$ and $x_{i,n}^e$ using interpolation factors $\alpha_k$ and $\beta_k$ in accordance with the equation $x_n^k = \alpha_k \cdot x_n^e + \cdot \beta_k \cdot x_{n-1}^e + (1 - \alpha_k - \beta_k) \cdot x_n^m$. The interpolation factors $\alpha_k$ and $\beta_k$ may be predetermined values such that $0 \le (\alpha_k,$ $\beta_k) \leq 1$. Here, k is an integer subframe number, where $1 \leq k \leq K-1$, where K is the total number of subframes in the current frame. The interpolation module 1249 accordingly interpolates LSF vectors corresponding to each subframe in the current frame. In some configurations, $\alpha_k=1$ and $\beta_k=0$ for the current frame end LSF vector $x_n^e$.

The interpolation module 1249 provides LSF vectors 1251 to the inverse coefficient transform 1253. The inverse coefficient transform 1253 transforms the LSF vectors 1251 into coefficients 1255 (e.g., filter coefficients for a synthesis filter 1/A(z)). The coefficients 1255 are provided to the synthesis filter 1257.

Inverse quantizer B 1273 receives and dequantizes an encoded excitation signal 1298 to produce an excitation signal 1275. In one example, the encoded excitation signal 1298 may include a fixed codebook index, a quantized fixed codebook gain, an adaptive codebook index and a quantized adaptive codebook gain. In this example, inverse quantizer B 1273 looks up a fixed codebook entry (e.g., vector) based on the fixed codebook index and applies a dequantized fixed codebook gain to the fixed codebook entry to obtain a fixed codebook contribution. Additionally, inverse quantizer B 1273 looks up an adaptive codebook entry based on the adaptive codebook index and applies a dequantized adaptive codebook gain to the adaptive codebook entry to obtain an adaptive codebook contribution. Inverse quantizer B 1273 may then sum the fixed codebook contribution and the adaptive codebook contribution to produce the excitation signal 1275.

The synthesis filter 1257 filters the excitation signal 1275 in accordance with the coefficients 1255 to produce a decoded speech signal 1259. For example, the poles of the synthesis filter 1257 may be configured in accordance with the coefficients 1255. The excitation signal 1275 is then passed through the synthesis filter 1257 to produce the decoded speech signal 1259 (e.g., a synthesized speech signal).

Figure 13:
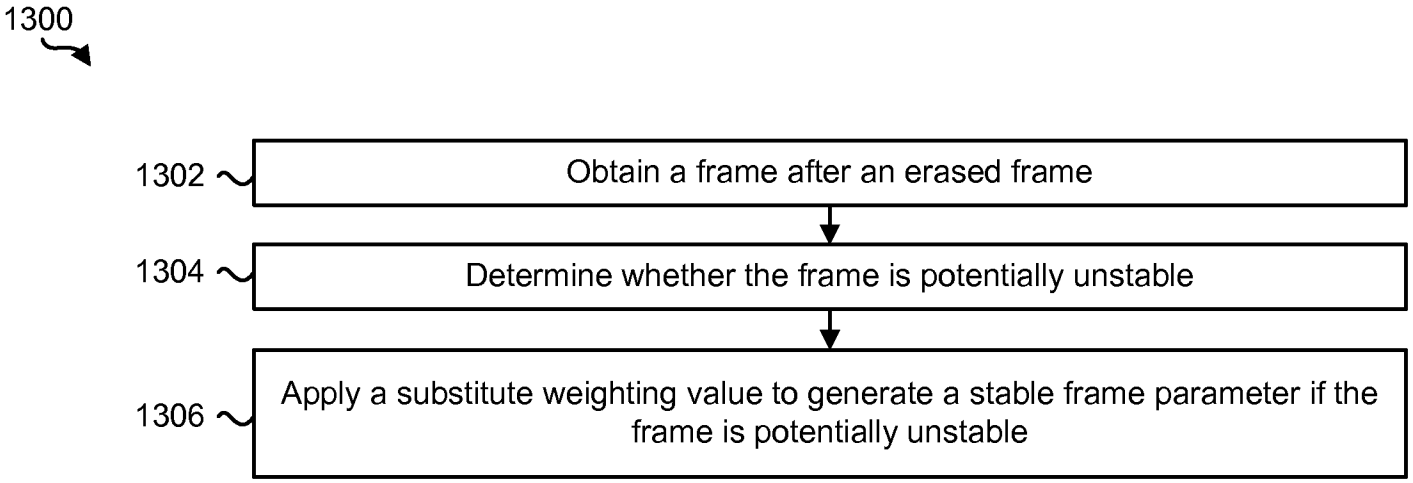
FIG. 13 is a flow diagram illustrating one configuration of a method for mitigating potential frame instability.

FIG. 13 is a flow diagram illustrating one configuration of a method 1300 for mitigating potential frame instability. An electronic device 1237 may obtain 1302 a frame after (e.g., subsequent in time to) an erased frame. For example, the electronic device 1237 may detect an erased frame based on one or more of a hash function, checksum, repetition code, parity bit(s), cyclic redundancy check (CRC), etc. The electronic device 1237 may then obtain 1302 a frame after the erased frame. The obtained 1302 frame may be the next frame after the erased frame or may be any number of frames after the erased frame. The obtained 1302 frame may be a correctly received frame.

The electronic device 1237 may determine 1304 whether the frame is potentially unstable. In some configurations, determining 1304 whether the frame is potentially unstable is based on whether a frame parameter (e.g., a current frame mid LSF vector) is ordered in accordance with a rule before any reordering (e.g., before reordering, if any). Additionally or alternatively, determining 1304 whether the frame is potentially unstable may be based on whether the frame (e.g., the current frame) is within a threshold number of frames since the erased frame. Additionally or alternatively, determining 1304 whether the frame is potentially unstable may be based on whether any frame between the frame (e.g., the current frame) and the erased frame utilizes non-predictive quantization.

In a first approach as described above, the electronic device 1237 determines 1304 that a frame is potentially unstable if the frame is received within a threshold number of frames after an erased frame and if no frame between the frame and the erased frame (if any) utilizes non-predictive quantization. In a second approach as described above, the electronic device 1237 determines 1304 that a frame is potentially unstable if the current frame is obtained after an erased frame, if a frame parameter (e.g., a current frame mid LSF vector $x_n^m$) was not ordered in accordance with a rule before any reordering and if no frame between the current frame and the erased frame (if any) utilizes non-predictive quantization. Additional or alternative approaches may be used. For example, the first approach may be applied for the first frame after an erased frame, while the second approach may be applied for subsequent frames.

The electronic device 1237 may apply 1306 a substitute weighting value to generate a stable frame parameter if the frame is potentially unstable. For example, the electronic device 1237 may generate a stable frame parameter (e.g., a substitute current frame mid LSF vector $x_n^m$) by applying a substitute weighting value to dequantized LSF vectors 1247 (e.g., to a current frame end LSF vector $x_n^e$ and a previous frame end LSF vector $x_{n-1}^e$). For instance, generating the stable frame parameter may include determining a substitute current frame mid LSF vector (e.g., $x_n^m$) that is equal to a product of a current frame end LSF vector (e.g., $x_n^e$) and the substitute weighting value (e.g., $w^{substitute}$) plus a product of a previous frame end LSF vector (e.g., $x_{n-1}^e$) and a difference of one and the substitute weighting value (e.g., $(1-w^{substitute})$). This may be accomplished as illustrated in Equation (3) or Equation (4), for instance.

Figure 14:
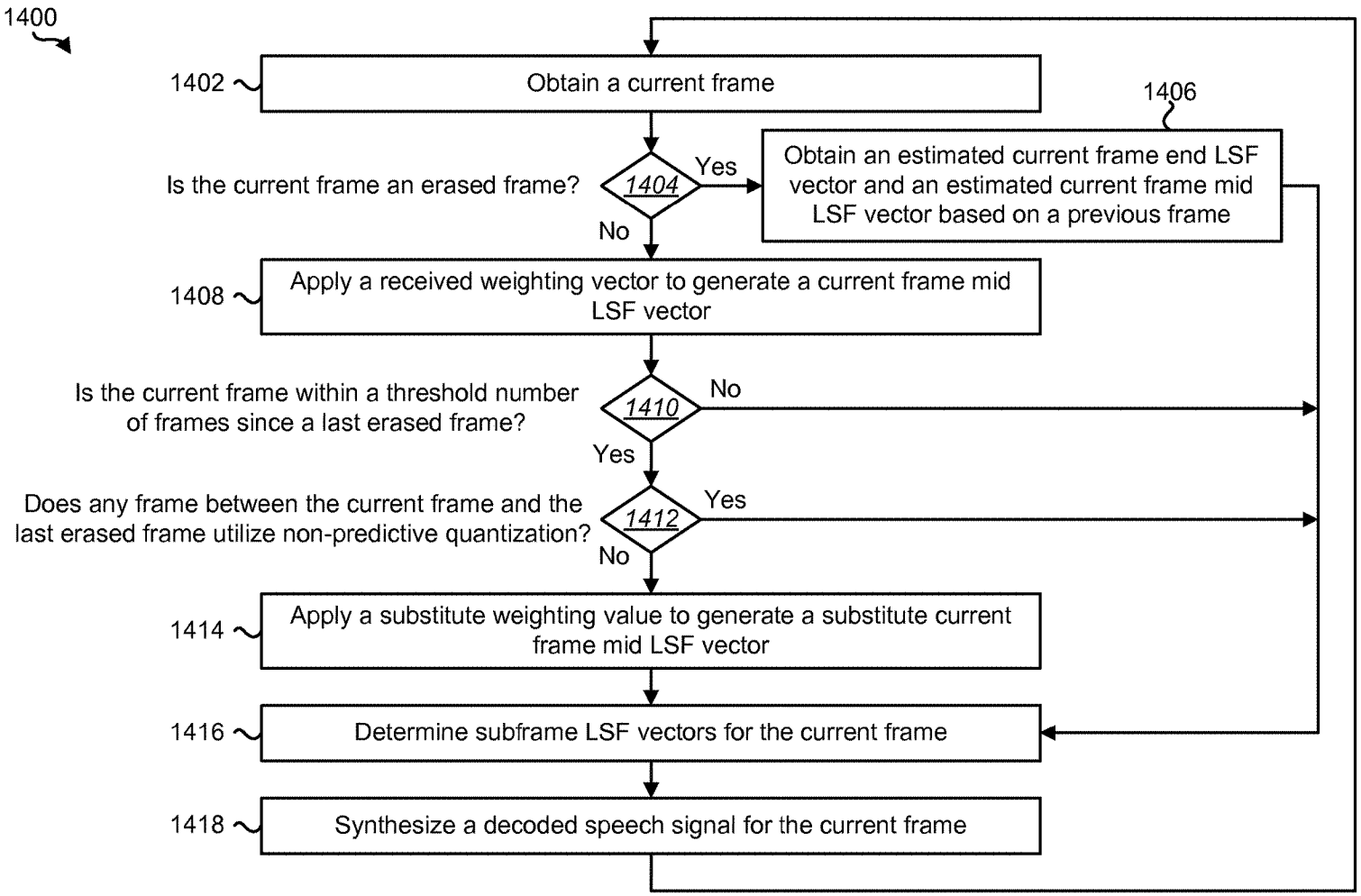
FIG. 14 is a flow diagram illustrating a more specific configuration of a method for mitigating potential frame instability.

FIG. 14 is a flow diagram illustrating a more specific configuration of a method 1400 for mitigating potential frame instability. An electronic device 1237 may obtain 1402 a current frame. For example, the electronic device 1237 may obtain parameters for a time period corresponding to the current frame.

The electronic device 1237 may determine 1404 whether the current frame is an erased frame. For example, the electronic device 1237 may detect an erased frame based on one or more of a hash function, checksum, repetition code, parity bit(s), cyclic redundancy check (CRC), etc.

If the current frame is an erased frame, the electronic device 1237 may obtain 1406 an estimated current frame end LSF vector and an estimated current frame mid LSF vector based on a previous frame. For example, the decoder 1208 may use error concealment for an erased frame. In error concealment, the decoder 1208 may copy a previous frame end LSF vector and a previous frame mid LSF vector as the estimated current frame LSF vector and the estimated current frame mid LSF vector, respectively. This procedure may be followed for consecutive erased frames.

In the case of two consecutive erased frames, for example, the second erased frame may include a copy of the end LSF vector from the first erased frame and all the interpolated LSF vectors, such as the mid LSF vector and subframe LSF vectors. Accordingly, the LSF vectors in the second erased frame may be approximately the same as the LSF vectors in the first erased frame. For example, the first erased frame end LSF vector may be copied from a previous frame. Thus, all LSF vectors in consecutive erased frames may be derived from the last correctly received frame. The last correctly received frame may have a very high probability of being stable. Consequently, there is a very little probability that consecutive erased frames have an unstable LSF vector. This is essentially because there may be no interpolation between two dissimilar LSF vectors in the case of consecutive erased frames. Accordingly, a substitute weighting value may not be applied for consecutively erased frames in some configurations.

The electronic device 1237 may determine 1416 subframe LSF vectors for the current frame. For example, the electronic device 1237 may interpolate the current frame end LSF vector, the current frame mid LSF vector and the previous frame end LSF vector based on interpolation factors to produce the subframe LSF vectors for the current frame. In some configurations, this may be accomplished in accordance with Equation (2).

The electronic device 1237 may synthesize 1418 a decoded speech signal 1259 for the current frame. For example, the electronic device 1237 may pass an excitation signal 1275 through a synthesis filter 1257 that is specified by coefficients 1255 based on the subframe LSF vectors 1251 to produce a decoded speech signal 1259.

If the current frame is not an erased frame, the electronic device 1237 may apply 1408 a received weighting vector to generate a current frame mid LSF vector. For example, the electronic device 1237 may multiply a current frame end LSF vector by the received weighting vector and may multiply a previous frame end LSF vector by 1 minus the received weighting vector. The electronic device 1237 may then sum the resulting products to generate the current frame mid LSF vector. This may be accomplished as provided in Equation (1).

The electronic device 1237 may determine 1410 whether the current frame is within a threshold number of frames since a last erased frame. For example, the electronic device 1237 may utilize a counter that counts each frame since the erased frame indicator 1267 indicated an erased frame. The counter may be reset each time an erased frame occurs. The electronic device 1237 may determine whether the counter is within the threshold number of frames. The threshold number may be one or more frames. If the current frame is not within the threshold number of frames since a last erased frame, the electronic device 1237 may determine 1416 subframe LSF vectors for the current frame and synthesize 1418 a decoded speech signal 1259 as described above. Determining 1410 whether the current frame is within a threshold number of frames since a last erased frame may reduce unnecessary processing for frames with a low probability of instability (e.g., for frames coming after one or more potentially unstable frames for which the potential instability has been mitigated).

If the current frame is within the threshold number of frames since a last erased frame, the electronic device 1237 may determine 1412 whether any frame between the current frame and the last erased frame utilizes non-predictive quantization. For example, the electronic device 1237 may receive the prediction mode indicator 1281 that indicates whether each frame utilizes predictive or non-predictive quantization. The electronic device 1237 may utilize the prediction mode indicator 1281 to track the prediction mode for each frame. If any frame between the current frame and the last erased frame utilizes non-predictive quantization, the electronic device 1237 may determine 1416 subframe LS F vectors for the current frame and synthesize 1418 a decoded speech signal 1259 as described above. Determining 1412 whether any frame between the current frame and the last erased frame utilizes non-predictive quantization may reduce unnecessary processing for frames with a low probability of instability (e.g., for frames coming after a frame that should include an accurate end LSF vector, since the end LSF vector was not quantized based on any previous frame).

If no frame between the current frame and the last erased frame utilizes non-predictive quantization (e.g., if all frames between the current frame and the last erased frame utilizes predictive quantization), the electronic device 1237 may apply 1414 a substitute weighting value to generate a substitute current frame mid LSF vector. In this case, the electronic device 1237 may determine that the current frame is potentially unstable and may apply the substitute weighting value to generate a stable frame parameter (e.g., the substitute current frame mid LSF vector). For example, the electronic device 1237 may multiply a current frame end LSF vector by the substitute weighting vector and may multiply a previous frame end LSF vector by 1 minus the substitute weighting vector. The electronic device 1237 may then sum the resulting products to generate the substitute current frame mid LSF vector. This may be accomplished as provided in Equation (3) or Equation (4).

The electronic device 1237 may then determine 1416 subframe LSF vectors for the current frame as described above. For example, the electronic device 1237 may interpolate the subframe LSF vectors based on the current frame end LSF vector, the previous frame end LSF vector, the substitute current frame mid LSF vector and interpolation factors. This may be accomplished in accordance with Equation (2). The electronic device 1237 may also synthesize 1418 a decoded speech signal 1259 as described above. For example, the electronic device 1237 may pass an excitation signal 1275 through a synthesis filter 1257 that is specified by coefficients 1255 based on the subframe LSF vectors 1251 (that are based on the substitute current mid LSF vector) to produce a decoded speech signal 1259.

Figure 15:
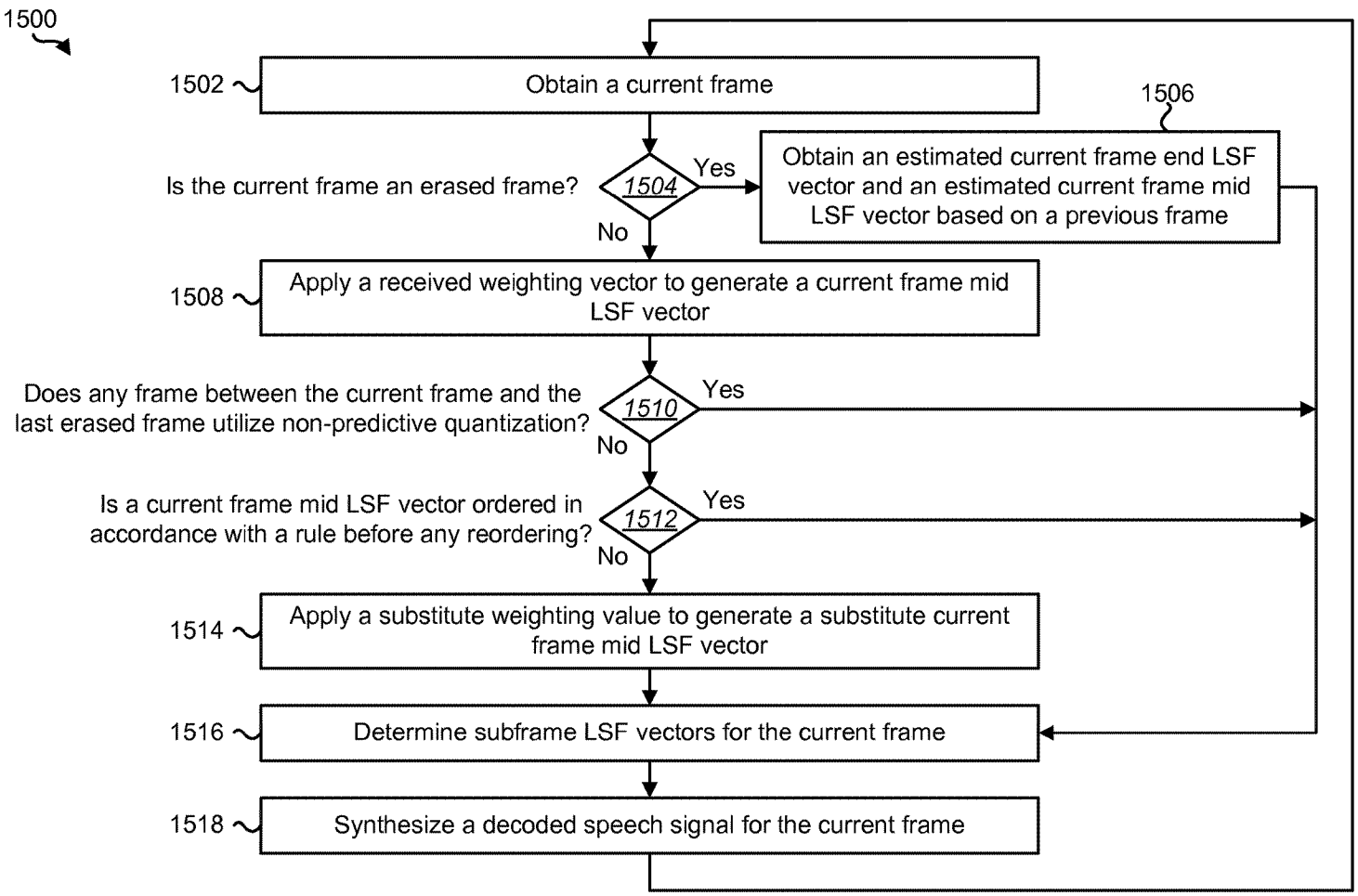
FIG. 15 is a flow diagram illustrating another more specific configuration of a method for mitigating potential frame instability.

FIG. 15 is a flow diagram illustrating another more specific configuration of a method 1500 for mitigating potential frame instability. An electronic device 1237 may obtain 1502 a current frame. For example, the electronic device 1237 may obtain parameters for a time period corresponding to the current frame.

The electronic device 1237 may determine 1504 whether the current frame is an erased frame. For example, the electronic device 1237 may detect an erased frame based on one or more of a hash function, checksum, repetition code, parity bit(s), cyclic redundancy check (CRC), etc.

If the current frame is an erased frame, the electronic device 1237 may obtain 1506 an estimated current frame end LSF vector and an estimated current frame mid LSF vector based on a previous frame. This may be accomplished as described above in connection with FIG. 14.

The electronic device 1237 may determine 1516 subframe LSF vectors for the current frame. This may be accomplished as described above in connection with FIG. 14. The electronic device 1237 may synthesize 1518 a decoded speech signal 1259 for the current frame. This may be accomplished as described above in connection with FIG. 14.

If the current frame is not an erased frame, the electronic device 1237 may apply 1508 a received weighting vector to generate a current frame mid LSF vector. This may be accomplished as described above in connection with FIG. 14.

The electronic device 1237 may determine 1510 whether any frame between the current frame and the last erased frame utilizes non-predictive quantization. This may be accomplished as described above in connection with FIG. 14. If any frame between the current frame and the last erased frame utilizes non-predictive quantization, the electronic device 1237 may determine 1516 subframe LSF vectors for the current frame and synthesize 1518 a decoded speech signal 1259 as described above.

If no frame between the current frame and the last erased frame utilizes non-predictive quantization (e.g., if all frames between the current frame and the last erased frame utilizes predictive quantization), the electronic device 1237 may determine 1512 whether a current frame mid LSF vector is ordered in accordance with a rule before any reordering. For example, the electronic device 1237 may determine whether each LSF in the mid LSF vector $x_n^m$ is in increasing order with at least a minimum separation between each LSF dimension pair before any reordering as described above in connection with FIG. 12. If the current frame mid LSF vector is ordered in accordance with the rule before any reordering, the electronic device 1237 may determine 1516 subframe LSF vectors for the current frame and synthesize 1518 a decoded speech signal 1259 as described above.

If the current frame mid LSF vector is not ordered in accordance with the rule before any reordering, the electronic device 1237 may apply 1514 a substitute weighting value to generate a substitute current frame mid LSF vector. In this case, the electronic device 1237 may determine that the current frame is potentially unstable and may apply the substitute weighting value to generate a stable frame parameter (e.g., the substitute current frame mid LSF vector). This may be accomplished as described above in connection with FIG. 14.

The electronic device 1237 may then determine 1516 subframe LSF vectors for the current frame and synthesize 1518 a decoded speech signal 1259 as described above in connection with FIG. 14. For example, the electronic device 1237 may pass an excitation signal 1275 through a synthesis filter 1257 that is specified by coefficients 1255 based on the subframe LSF vectors 1251 (that are based on the substitute current mid LSF vector) to produce a decoded speech signal 1259.

Figure 16:
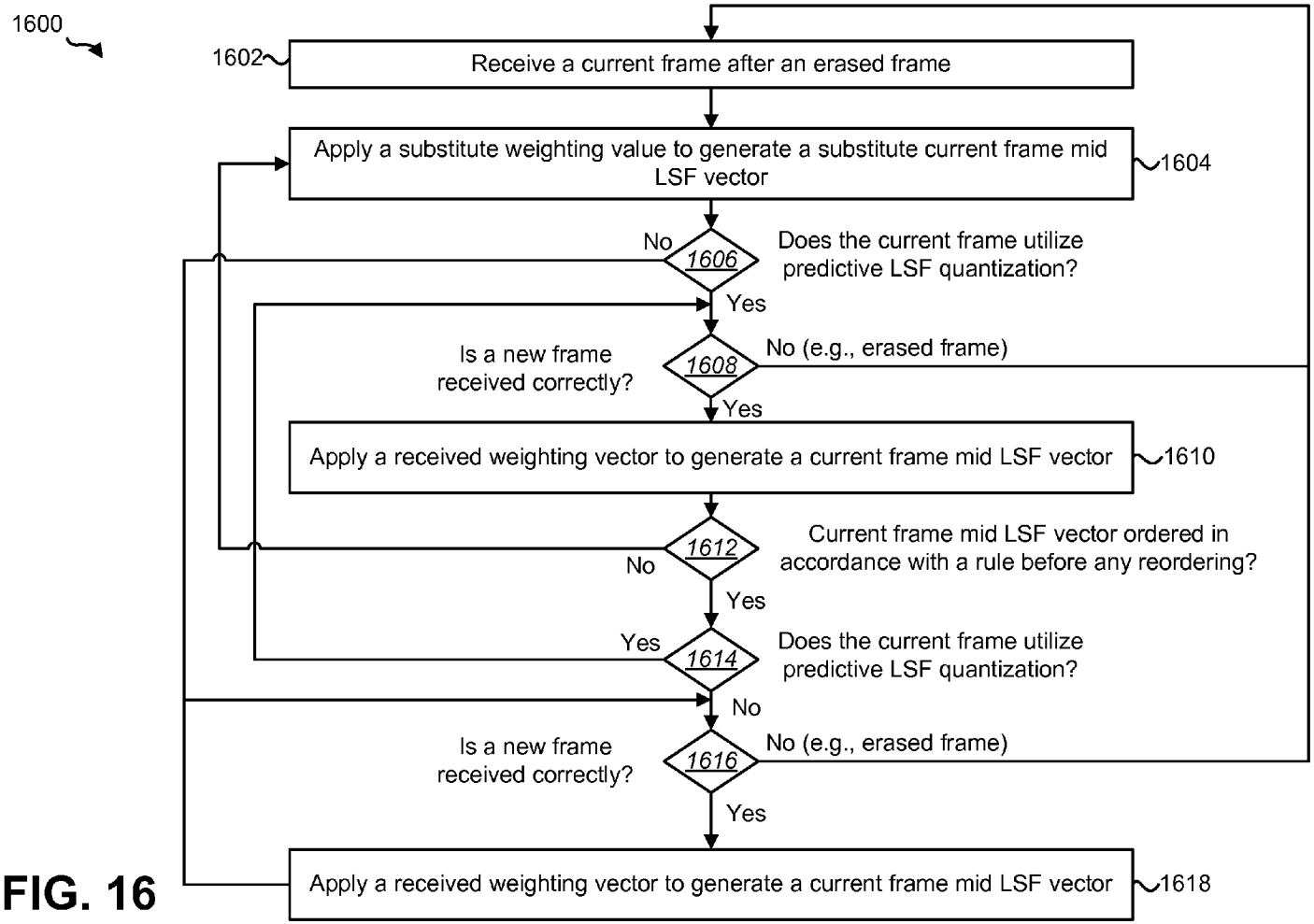
FIG. 16 is a flow diagram illustrating another more specific configuration of a method for mitigating potential frame instability.

FIG. 16 is a flow diagram illustrating another more specific configuration of a method 1600 for mitigating potential frame instability. For example, some configurations of the systems and methods disclosed herein may be applied in two procedures: detecting a potential LSF instability and mitigating the potential LSF instability.

An electronic device 1237 may receive 1602 a frame after an erased frame. For example, the electronic device 1237 may detect an erased frame and receive one or more frames after the erased frame. More specifically, the electronic device 1237 may receive parameters corresponding to frames after the erased frame.

The electronic device 1237 may determine whether there is a potential for the current frame mid LSF vector to be unstable. In some implementations, the electronic device 1237 may assume that one or more frames after an erased frame are potentially unstable (e.g., they include a potentially unstable mid LSF vector).

If a potential instability is detected, the received weighting vector $w_n$ used for interpolation/extrapolation by the encoder (transmitted as an index to the decoder 1208, for example) may be discarded. For example, the electronic device 1237 (e.g., decoder 1208) may discard the weighting vector.

The electronic device 1237 may apply 1604 a substitute weighting value to generate a (stable) substitute current frame mid LSF vector. For example, the decoder 1208 applies a substitute weighting value $w^{substitute}$ as described above in connection with FIG. 12.

The instability of the LSF vectors can propagate if subsequent frames (e.g., n+1, n+2, etc.) use predictive quantization techniques to quantize the end LSF vectors. Hence, for the current frame and subsequent frame received 1608 until the electronic device 1237 determines 1606, 1614 that non-predictive LSF quantization techniques are utilized for a frame, the decoder 1208 may determine 1612 whether the current frame mid LSF vector is ordered in accordance with a rule before any reordering. More specifically, the electronic device 1237 may determine 1606 whether the current frame utilizes predictive LSF quantization. If the current frame utilizes predictive LSF quantization, the electronic device 1237 may determine 1608 whether a new frame (e.g., next frame) is correctly received. If the new frame is not correctly received (e.g., the new frame is an erased frame), then operation may proceed to receiving 1602 a current frame after the erased frame. If the electronic device 1237 determines 1608 that a new frame is correctly received, the electronic device 1237 may apply 1610 a received weighting vector to generate a current frame mid LSF vector. For example, the electronic device 1237 may use the current weighting vector for the current frame mid LSF (initially without replacing it). Accordingly, for all (correctly received) subsequent frames until non-predictive LSF quantization techniques are used, the decoder may apply 1610 a received weighting vector to generate a current frame mid LSF vector and determine 1612 whether the current frame mid LSF vector is ordered in accordance with a rule before any reordering. For example, the electronic device 1237 may apply 1610 a weighting vector based on an index transmitted from an encoder for mid LSF vector interpolation. Then, the electronic device 1237 may determine 1612 if the current frame mid LSF vector corresponding to the frame is ordered such that $x_{1,n}^m+\Delta \leq x_{2,n}^m+\Delta \leq \ldots \leq x_{M,n}^m$ before any reordering.

If violation of the rule is detected, the mid LSF vector is potentially unstable. For example, if the electronic device 1237 determines 1612 that the mid LSF vector corresponding to the frame is not ordered in accordance with the rule before any reordering, the electronic device 1237 accordingly determines that the LSF dimensions in the mid LSF vector are potentially unstable. The decoder 1208 may mitigate the potential instability by applying 1604 the substitute weighting value as described above.

If the current frame mid LSF vector is ordered in accordance with the rule, the electronic device 1237 may determine 1614 whether the current frame utilizes predictive quantization. If the current frame utilizes predictive quantization, the electronic device 1237 may apply 1604 the substitute weighting value as described above. If the electronic device 1237 determines 1614 that the current frame does not utilize predictive quantization (e.g., that the current frame utilizes non-predictive quantization), the electronic device 1237 may determine 1616 whether a new frame is received correctly. If a new frame is not received correctly (e.g., if the new frame is an erased frame), operation may proceed to receiving 1602 a current frame after an erased frame.

If the current frame utilizes non-predictive quantization and if the electronic device 1237 determines 1616 that a new frame is received correctly, the decoder 1208 continues to operate normally using the received weighting vector that is used in a regular mode of operation. In other words, the electronic device 1237 may apply 1618 a received weighting vector based on the index transmitted from the encoder for mid LSF vector interpolation for each correctly received frame. In particular, the electronic device 1237 may apply 1618 the received weighting vector based on the index received from the encoder for each subsequent frame (e.g., $n+n_{np}+1$, $n+n_{np}+2$, etc., where $n_{np}$ is the frame number of a frame that utilizes non-predictive quantization) until an erased frame occurs.

The systems and methods disclosed herein may be implemented in a decoder 1208. In some configurations, no additional bits are needed to be transmitted from the encoder to the decoder 1208 to enable detection and mitigation of potential frame instability. Furthermore, the systems and methods disclosed herein do not degrade the quality in clean channel conditions.

Figure 17:
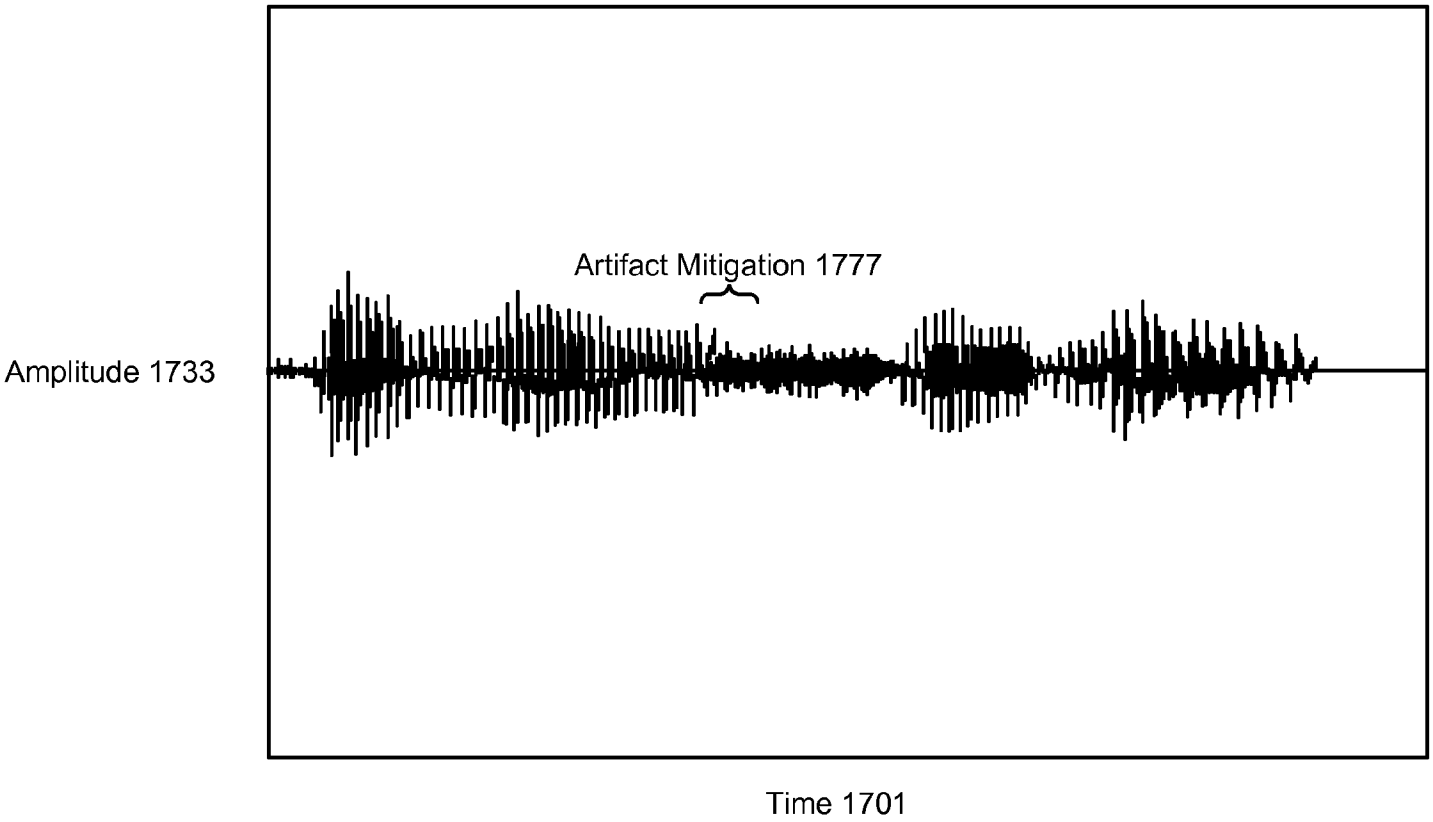
FIG. 17 is a graph illustrating an example of a synthesized speech signal.

FIG. 17 is a graph illustrating an example of a synthesized speech signal. The horizontal axis of the graph is illustrated in time 1701 (e.g., seconds) and the vertical axis of the graph is illustrated in amplitude 1733 (e.g., a number, a value). The amplitude 1733 may be a number represented in bits. In some configurations, 16 bits may be utilized to represent samples of a speech signal ranging in value between −32768 to 32767, which corresponds to a range (e.g., a value between −1 and +1 in floating point). It should be noted that the amplitude 1733 may be represented differently based on the implementation. In some examples, the value of the amplitude 1733 may correspond to an electromagnetic signal characterized by voltage (in volts) and/or current (in amps).

The systems and methods disclosed herein may be implemented to generate the synthesized speech signal as given in FIG. 17. In other words, FIG. 17 is graph illustrating one example of a synthesized speech signal resulting from the application of the systems and methods disclosed herein. The corresponding waveform without applying the systems and methods disclosed herein is shown in FIG. 11. As can be observed, the systems and methods disclosed herein provide artifact mitigation 1777. In other words, the artifacts 1135 illustrated in FIG. 11 are mitigated or removed by applying the systems and methods disclosed herein, as illustrated in FIG. 17.

Figure 18:
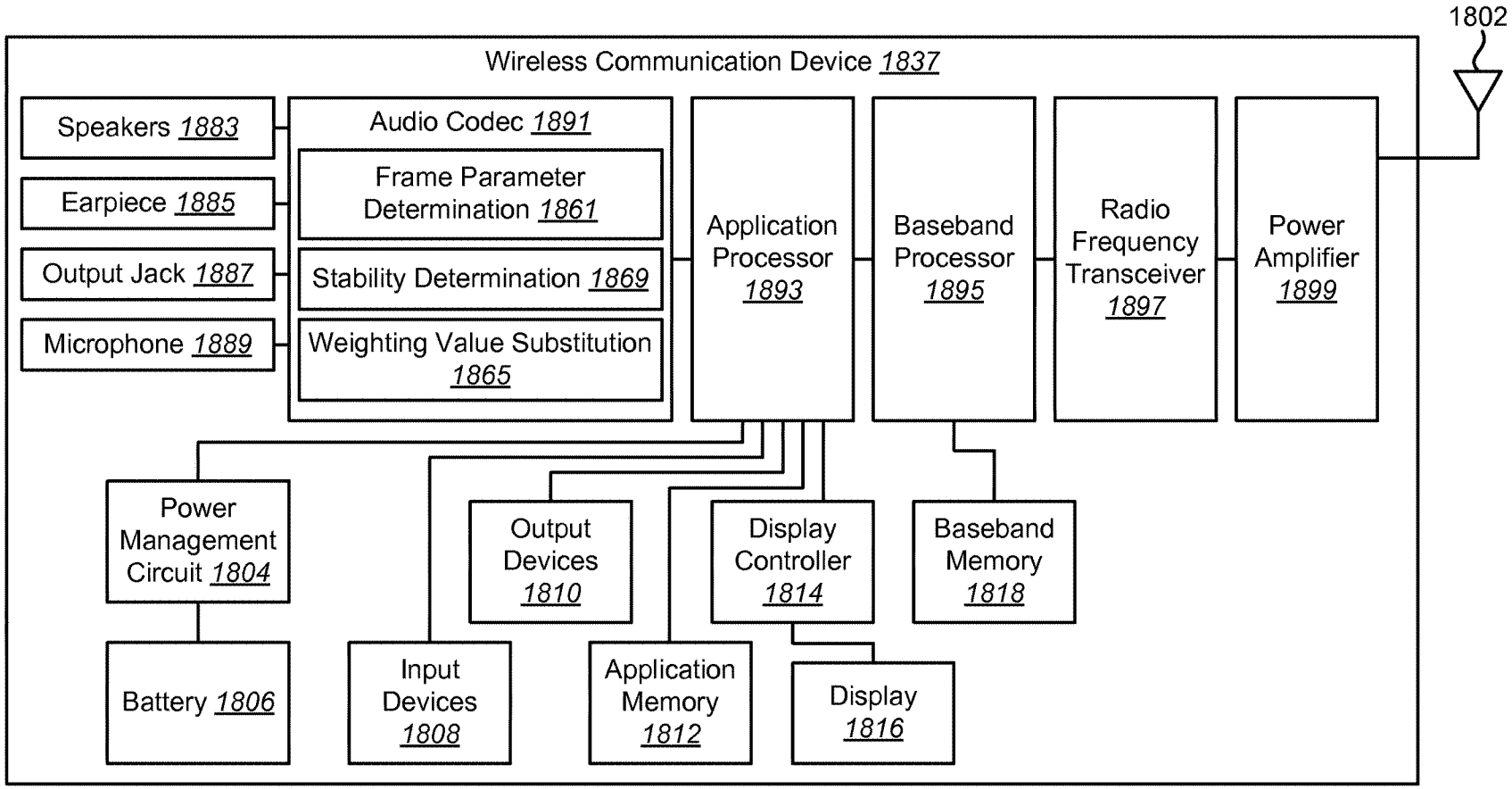
FIG. 18 is a block diagram illustrating one configuration of a wireless communication device in which systems and methods for mitigating potential frame instability may be implemented.

FIG. 18 is a block diagram illustrating one configuration of a wireless communication device 1837 in which systems and methods for mitigating potential frame instability may be implemented. The wireless communication device 1837 illustrated in FIG. 18 may be an example of at least one of the electronic devices described herein. The wireless communication device 1837 may include an application processor 1893. The application processor 1893 generally processes instructions (e.g., runs programs) to perform functions on the wireless communication device 1837. The application processor 1893 may be coupled to an audio coder/decoder (codec) 1891.

The audio codec 1891 may be used for coding and/or decoding audio signals. The audio codec 1891 may be coupled to at least one speaker 1883, an earpiece 1885, an output jack 1887 and/or at least one microphone 1889. The speakers 1883 may include one or more electro-acoustic transducers that convert electrical or electronic signals into acoustic signals. For example, the speakers 1883 may be used to play music or output a speakerphone conversation, etc. The earpiece 1885 may be another speaker or electro-acoustic transducer that can be used to output acoustic signals (e.g., speech signals) to a user. For example, the earpiece 1885 may be used such that only a user may reliably hear the acoustic signal. The output jack 1887 may be used for coupling other devices to the wireless communication device 1837 for outputting audio, such as headphones. The speakers 1883, earpiece 1885 and/or output jack 1887 may generally be used for outputting an audio signal from the audio codec 1891. The at least one microphone 1889 may be an acousto-electric transducer that converts an acoustic signal (such as a user's voice) into electrical or electronic signals that are provided to the audio codec 1891.

The audio codec 1891 (e.g., a decoder) may include a frame parameter determination module 1861, a stability determination module 1869 and/or a weighting value substitution module 1865. The frame parameter determination module 1861, the stability determination module 1869 and/or the weighting value substitution module 1865 may function as described above in connection with FIG. 12.

The application processor 1893 may also be coupled to a power management circuit 1804. One example of a power management circuit 1804 is a power management integrated circuit (PMIC), which may be used to manage the electrical power consumption of the wireless communication device 1837. The power management circuit 1804 may be coupled to a battery 1806. The battery 1806 may generally provide electrical power to the wireless communication device 1837. For example, the battery 1806 and/or the power management circuit 1804 may be coupled to at least one of the elements included in the wireless communication device 1837.

The application processor 1893 may be coupled to at least one input device 1808 for receiving input. Examples of input devices 1808 include infrared sensors, image sensors, accelerometers, touch sensors, keypads, etc. The input devices 1808 may allow user interaction with the wireless communication device 1837. The application processor 1893 may also be coupled to one or more output devices 1810. Examples of output devices 1810 include printers, projectors, screens, haptic devices, etc. The output devices 1810 may allow the wireless communication device 1837 to produce output that may be experienced by a user.

The application processor 1893 may be coupled to application memory 1812. The application memory 1812 may be any electronic device that is capable of storing electronic information. Examples of application memory 1812 include double data rate synchronous dynamic random access memory (DDRAM), synchronous dynamic random access memory (SDRAM), flash memory, etc. The application memory 1812 may provide storage for the application processor 1893. For instance, the application memory 1812 may store data and/or instructions for the functioning of programs that are run on the application processor 1893.

The application processor 1893 may be coupled to a display controller 1814, which in turn may be coupled to a display 1816. The display controller 1814 may be a hardware block that is used to generate images on the display 1816. For example, the display controller 1814 may translate instructions and/or data from the application processor 1893 into images that can be presented on the display 1816. Examples of the display 1816 include liquid crystal display (LCD) panels, light emitting diode (LED) panels, cathode ray tube (CRT) displays, plasma displays, etc.

The application processor 1893 may be coupled to a baseband processor 1895. The baseband processor 1895 generally processes communication signals. For example, the baseband processor 1895 may demodulate and/or decode received signals. Additionally or alternatively, the baseband processor 1895 may encode and/or modulate signals in preparation for transmission.

The baseband processor 1895 may be coupled to baseband memory 1818. The baseband memory 1818 may be any electronic device capable of storing electronic information, such as SDRAM, DDRAM, flash memory, etc. The baseband processor 1895 may read information (e.g., instructions and/or data) from and/or write information to the baseband memory 1818. Additionally or alternatively, the baseband processor 1895 may use instructions and/or data stored in the baseband memory 1818 to perform communication operations.

The baseband processor 1895 may be coupled to a radio frequency (RF) transceiver 1897. The RF transceiver 1897 may be coupled to a power amplifier 1899 and one or more antennas 1802. The RF transceiver 1897 may transmit and/or receive radio frequency signals. For example, the RF transceiver 1897 may transmit an RF signal using a power amplifier 1899 and at least one antenna 1802. The RF transceiver 1897 may also receive RF signals using the one or more antennas 1802. It should be noted that one or more of the elements included in the wireless communication device 1837 may be coupled to a general bus that may enable communication between the elements.

Figure 19:
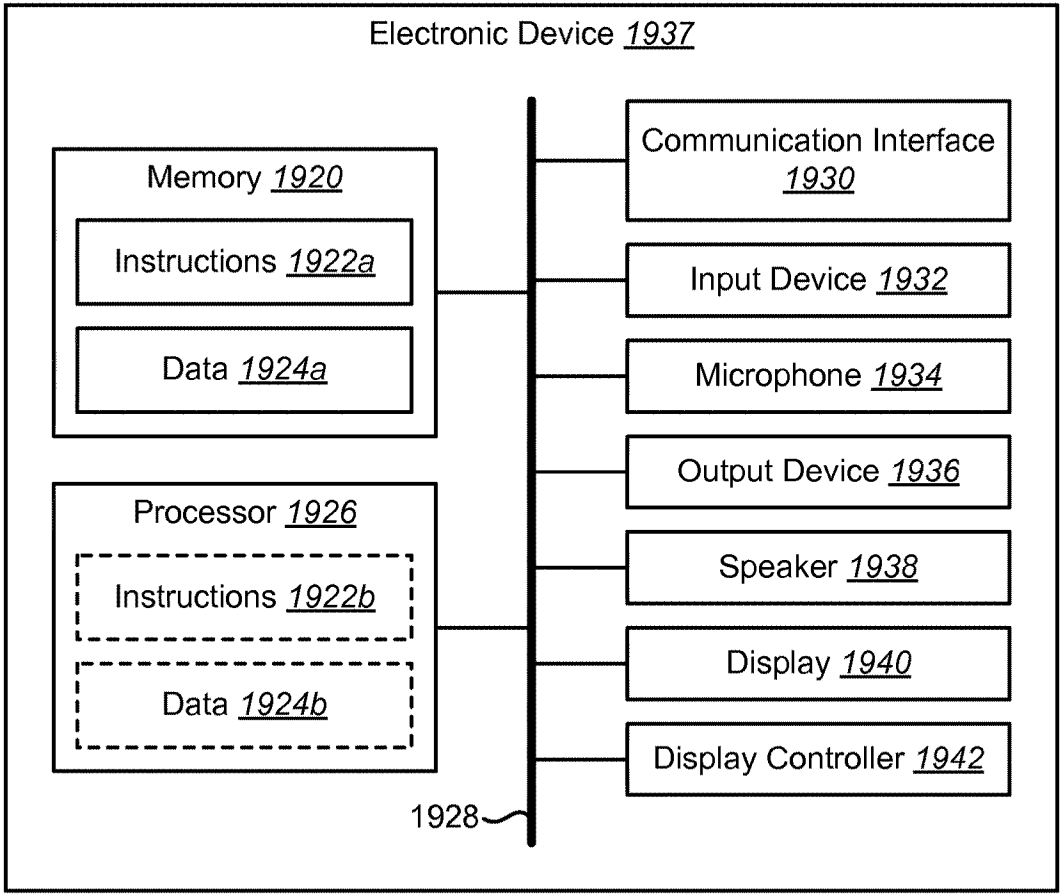
FIG. 19 illustrates various components that may be utilized in an electronic device.

FIG. 19 illustrates various components that may be utilized in an electronic device 1937. The illustrated components may be located within the same physical structure or in separate housings or structures. The electronic device 1937 described in connection with FIG. 19 may be implemented in accordance with one or more of the electronic devices described herein. The electronic device 1937 includes a processor 1926. The processor 1926 may be a general purpose single- or multi-chip microprocessor (e.g., an ARM), a special purpose microprocessor (e.g., a digital signal processor (DSP)), a microcontroller, a programmable gate array, etc. The processor 1926 may be referred to as a central processing unit (CPU). Although just a single processor 1926 is shown in the electronic device 1937 of FIG. 19, in an alternative configuration, a combination of processors (e.g., an ARM and DSP) could be used.

The electronic device 1937 also includes memory 1920 in electronic communication with the processor 1926. That is, the processor 1926 can read information from and/or write information to the memory 1920. The memory 1920 may be any electronic component capable of storing electronic information. The memory 1920 may be random access memory (RAM), read-only memory (ROM), magnetic disk storage media, optical storage media, flash memory devices in RAM, on-board memory included with the processor, programmable read-only memory (PROM), erasable programmable read-only memory (EPROM), electrically erasable PROM (EEPROM), registers, and so forth, including combinations thereof.

Data 1924*a* and instructions 1922*a* may be stored in the memory 1920. The instructions 1922*a* may include one or more programs, routines, sub-routines, functions, procedures, etc. The instructions 1922*a* may include a single computer-readable statement or many computer-readable statements. The instructions 1922*a* may be executable by the processor 1926 to implement one or more of the methods, functions and procedures described above. Executing the instructions 1922*a* may involve the use of the data 1924*a* that is stored in the memory 1920. FIG. 19 shows some instructions 1922*b* and data 1924*b* being loaded into the processor 1926 (which may come from instructions 1922*a* and data 1924*a*).

The electronic device 1937 may also include one or more communication interfaces 1930 for communicating with other electronic devices. The communication interfaces 1930 may be based on wired communication technology, wireless communication technology, or both. Examples of different types of communication interfaces 1930 include a serial port, a parallel port, a Universal Serial Bus (USB), an Ethernet adapter, an IEEE 1394 bus interface, a small computer system interface (SCSI) bus interface, an infrared (IR) communication port, a Bluetooth wireless communication adapter, and so forth.

The electronic device 1937 may also include one or more input devices 1932 and one or more output devices 1936. Examples of different kinds of input devices 1932 include a keyboard, mouse, microphone, remote control device, button, joystick, trackball, touchpad, lightpen, etc. For instance, the electronic device 1937 may include one or more microphones 1934 for capturing acoustic signals. In one configuration, a microphone 1934 may be a transducer that converts acoustic signals (e.g., voice, speech) into electrical or electronic signals. Examples of different kinds of output devices 1936 include a speaker, printer, etc. For instance, the electronic device 1937 may include one or more speakers 1938. In one configuration, a speaker 1938 may be a transducer that converts electrical or electronic signals into acoustic signals. One specific type of output device which may be typically included in an electronic device 1937 is a display device 1940. Display devices 1940 used with configurations disclosed herein may utilize any suitable image projection technology, such as a cathode ray tube (CRT), liquid crystal display (LCD), light-emitting diode (LED), gas plasma, electroluminescence, or the like. A display controller 1942 may also be provided, for converting data stored in the memory 1920 into text, graphics, and/or moving images (as appropriate) shown on the display device 1940.

The various components of the electronic device 1937 may be coupled together by one or more buses, which may include a power bus, a control signal bus, a status signal bus, a data bus, etc. For simplicity, the various buses are illustrated in FIG. 19 as a bus system 1928. It should be noted that FIG. 19 illustrates only one possible configuration of an electronic device 1937. Various other architectures and components may be utilized.

In the above description, reference numbers have sometimes been used in connection with various terms. Where a term is used in connection with a reference number, this may be meant to refer to a specific element that is shown in one or more of the Figures. Where a term is used without a reference number, this may be meant to refer generally to the term without limitation to any particular Figure.

The term "determining" encompasses a wide variety of actions and, therefore, "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing and the like.

The phrase "based on" does not mean "based only on," unless expressly specified otherwise. In other words, the phrase "based on" describes both "based only on" and "based at least on."

It should be noted that one or more of the features, functions, procedures, components, elements, structures, etc., described in connection with any one of the configurations described herein may be combined with one or more of the functions, procedures, components, elements, structures, etc., described in connection with any of the other configurations described herein, where compatible. In other words, any compatible combination of the functions, procedures, components, elements, etc., described herein may be implemented in accordance with the systems and methods disclosed herein.

The functions described herein may be stored as one or more instructions on a processor-readable or computer-readable medium. The term "computer-readable medium" refers to any available medium that can be accessed by a computer or processor. By way of example, and not limitation, such a medium may comprise RAM, ROM, EEPROM, flash memory, CD-ROM or other optical disk storage, magnetic disk storage or other magnetic storage devices, or any other medium that can be used to store desired program code in the form of instructions or data structures and that can be accessed by a computer. Disk and disc, as used herein, includes compact disc (CD), laser disc, optical disc, digital versatile disc (DVD), floppy disk and Blu-ray® disc where disks usually reproduce data magnetically, while discs reproduce data optically with lasers. It should be noted that a computer-readable medium may be tangible and non-transitory. The term "computer-program product" refers to a computing device or processor in combination with code or instructions (e.g., a "program") that may be executed, processed or computed by the computing device or processor. As used herein, the term "code" may refer to software, instructions, code or data that is/are executable by a computing device or processor.

Software or instructions may also be transmitted over a transmission medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of transmission medium.

The methods disclosed herein comprise one or more steps or actions for achieving the described method. The method steps and/or actions may be interchanged with one another without departing from the scope of the claims. In other words, unless a specific order of steps or actions is required for proper operation of the method that is being described, the order and/or use of specific steps and/or actions may be modified without departing from the scope of the claims.

It is to be understood that the claims are not limited to the precise configuration and components illustrated above. Various modifications, changes and variations may be made in the arrangement, operation and details of the systems, methods, and apparatus described herein without departing from the scope of the claims.

What is claimed is:

1. A method for mitigating potential frame instability by an electronic device, comprising:

obtaining a first frame of a speech signal subsequent in time to an erased frame, wherein the first frame is a correctly received frame;

generating a previous frame end line spectral frequency vector with frame erasure concealment;

applying a received weighting vector to a first frame end line spectral frequency vector and to the previous frame end line spectral frequency vector to generate a first frame mid line spectral frequency vector, wherein the received weighting vector corresponds to the first frame and is received from an encoder;

determining whether the first frame is potentially unstable;

applying a substitute weighting value instead of the received weighting vector to the first frame end line spectral frequency vector and to the previous frame end line spectral frequency vector to generate a stable frame parameter in response to determining that the first frame is potentially unstable, wherein the stable frame parameter is a mid line spectral frequency vector between the first frame end line spectral frequency vector and the previous frame end line spectral frequency vector; and synthesizing a decoded speech signal based on the stable frame parameter.

2. The method of claim 1, further comprising interpolating a plurality of subframe line spectral frequency vectors based on the mid line spectral frequency vector.

3. The method of claim 1, further comprising:

receiving an encoded excitation signal; and dequantizing the encoded excitation signal to produce an excitation signal, wherein synthesizing the decoded speech signal comprises filtering the excitation signal based on the stable frame parameter.

4. The method of claim 1, wherein the substitute weighting value is between 0 and 1.

5. The method of claim 1, wherein generating the stable frame parameter comprises determining the mid line spectral frequency vector that is equal to a product of the first frame end line spectral frequency vector and the substitute weighting value plus a product of the previous frame end line spectral frequency vector and a difference of one and the substitute weighting value.

6. The method of claim 1, wherein the substitute weighting value is selected based on at least one of a classification of two frames and a line spectral frequency difference between the two frames.

7. The method of claim 1, wherein determining whether the first frame is potentially unstable is based on whether a first frame mid line spectral frequency is ordered in accordance with a rule before any reordering.

8. The method of claim 1, wherein determining whether the first frame is potentially unstable is based on whether the first frame is within a threshold number of frames after the erased frame.

9. The method of claim 1, wherein determining whether the first frame is potentially unstable is based on whether any frame between the first frame and the erased frame utilizes non-predictive quantization.

10. An electronic device for mitigating potential frame instability, comprising:

decoder circuitry configured to generate a previous frame end line spectral frequency vector with frame erasure concealment;

frame parameter determination circuitry configured to obtain a first frame of a speech signal subsequent in time to an erased frame, wherein the first frame is a correctly received frame, and configured to apply a received weighting vector to a first frame end line spectral frequency vector and to the previous frame end line spectral frequency vector to generate a first frame mid line spectral frequency vector, wherein the received weighting vector corresponds to the first frame and is received from an encoder;

stability determination circuitry coupled to the frame parameter determination circuitry, wherein the stability determination circuitry is configured to determine whether the first frame is potentially unstable;

weighting value substitution circuitry coupled to the stability determination circuitry, wherein the weighting value substitution circuitry is configured to apply a substitute weighting value instead of the received weighting vector to the first frame end line spectral frequency vector and to the previous frame end line spectral frequency vector to generate a stable frame parameter in response to determining that the first frame is potentially unstable, wherein the stable frame parameter is a mid line spectral frequency vector between the first frame end line spectral frequency vector and the previous frame end line spectral frequency vector; and a synthesis filter configured to synthesize a decoded speech signal based on the stable frame parameter.

11. The electronic device of claim 10, further comprising interpolation circuitry configured to interpolate a plurality of subframe line spectral frequency vectors based on the mid line spectral frequency vector.

12. The electronic device of claim 10, further comprising inverse quantizer circuitry configured to receive and dequantize an encoded excitation signal to produce an excitation signal, wherein the synthesis filter is configured to synthesize the decoded speech signal by filtering the excitation signal based on the stable frame parameter.

13. The electronic device of claim 10, wherein the substitute weighting value is between 0 and 1.

14. The electronic device of claim 10, wherein the weighting value substitution circuitry is configured to determine the mid line spectral frequency vector that is equal to a product of the first frame end line spectral frequency vector and the substitute weighting value plus a product of the previous frame end line spectral frequency vector and a difference of one and the substitute weighting value.

15. The electronic device of claim 10, wherein the weighting value substitution circuitry is configured to select the substitute weighting value based on at least one of a classification of two frames and a line spectral frequency difference between the two frames.

16. The electronic device of claim 10, wherein the stability determination circuitry is configured to determine whether the first frame is potentially unstable based on whether a first frame mid line spectral frequency is ordered in accordance with a rule before any reordering.

17. The electronic device of claim 10, wherein the stability determination circuitry is configured to determine whether the first frame is potentially unstable based on whether the first frame is within a threshold number of frames after the erased frame.

18. The electronic device of claim 10, wherein the stability determination circuitry is configured to determine whether the first frame is potentially unstable based on whether any frame between the first frame and the erased frame utilizes non-predictive quantization.

19. A computer-program product for mitigating potential frame instability, comprising a non-transitory tangible computer-readable medium having instructions thereon, the instructions comprising:

code for causing an electronic device to obtain a first frame of a speech signal subsequent in time to an erased frame, wherein the first frame is a correctly received frame;

code for causing the electronic device to generate an erased previous frame end line spectral frequency vector with frame erasure concealment;

code for causing the electronic device to apply a received weighting vector to a first frame end line spectral frequency vector and to the previous frame end line spectral frequency vector to generate a first frame mid line spectral frequency vector, wherein the received weighting vector corresponds to the first frame and is received from an encoder;

code for causing the electronic device to determine whether the first frame is potentially unstable;

code for causing the electronic device to apply a substitute weighting value instead of the received weighting vector to the first frame end line spectral frequency vector and to the previous frame end line spectral frequency vector to generate a stable frame parameter in response to determining that the first frame is potentially unstable, wherein the stable frame parameter is a mid line spectral frequency vector between the first frame end line spectral frequency vector and the previous frame end line spectral frequency vector; and code for causing the electronic device to synthesize a decoded speech signal based on the stable frame parameter.

20. The computer-program product of claim 19, further comprising code for causing the electronic device to interpolate a plurality of subframe line spectral frequency vectors based on the mid line spectral frequency vector.

21. The computer-program product of claim 19, further comprising:

code for causing the electronic device to receive an encoded excitation signal; and code for causing the electronic device to dequantize the encoded excitation signal to produce an excitation signal, wherein the code for causing the electronic device to synthesize the decoded speech signal comprises code for causing the electronic device to filter the excitation signal based on the stable frame parameter.

22. The computer-program product of claim 19, wherein the substitute weighting value is between 0 and 1.

23. The computer-program product of claim 19, wherein generating the stable frame parameter comprises determining the mid line spectral frequency vector that is equal to a product of the first frame end line spectral frequency vector and the substitute weighting value plus a product of the previous frame end line spectral frequency vector and a difference of one and the substitute weighting value.

24. The computer-program product of claim 19, wherein the substitute weighting value is selected based on at least one of a classification of two frames and a line spectral frequency difference between the two frames.

25. The computer-program product of claim 19, wherein determining whether the first frame is potentially unstable is based on whether a first frame mid line spectral frequency is ordered in accordance with a rule before any reordering.

26. The computer-program product of claim 19, wherein determining whether the first frame is potentially unstable is based on whether the first frame is within a threshold number of frames after the erased frame.

27. The computer-program product of claim 19, wherein determining whether the first frame is potentially unstable is based on whether any frame between the first frame and the erased frame utilizes non-predictive quantization.

28. An apparatus for mitigating potential frame instability, comprising:

means for obtaining a first frame of a speech signal subsequent in time to an erased frame, wherein the first frame is a correctly received frame;

means for generating a previous frame end line spectral frequency vector with frame erasure concealment;

means for applying a received weighting vector to a first frame end line spectral frequency vector and to the previous frame end line spectral frequency vector to generate a first frame mid line spectral frequency vector, wherein the received weighting vector corresponds to the first frame and is received from an encoder;

means for determining whether the first frame is potentially unstable;

means for applying a substitute weighting value instead of the received weighting vector to the first frame end line spectral frequency vector and to the previous frame end line spectral frequency vector to generate a stable frame parameter in response to determining that the first frame is potentially unstable, wherein the stable frame parameter is a mid line spectral frequency vector between the first frame end line spectral frequency vector and the previous frame end line spectral frequency vector; and means for synthesizing a decoded speech signal based on the stable frame parameter.

29. The apparatus of claim 28, further comprising means for interpolating a plurality of subframe line spectral frequency vectors based on the mid line spectral frequency vector.

30. The apparatus of claim 28, further comprising:

means for receiving an encoded excitation signal; and means for dequantizing the encoded excitation signal to produce an excitation signal, wherein the means for synthesizing the decoded speech signal comprises means for filtering the excitation signal based on the stable frame parameter.

31. The apparatus of claim 28, wherein the substitute weighting value is between 0 and 1.

32. The apparatus of claim 28, wherein generating the stable frame parameter comprises determining the mid line spectral frequency vector that is equal to a product of the first frame end line spectral frequency vector and the substitute weighting value plus a product of the previous frame end line spectral frequency vector and a difference of one and the substitute weighting value.

33. The apparatus of claim 28, wherein the substitute weighting value is selected based on at least one of a classification of two frames and a line spectral frequency difference between the two frames.

34. The apparatus of claim 28, wherein determining whether the first frame is potentially unstable is based on whether a first frame mid line spectral frequency is ordered in accordance with a rule before any reordering.

35. The apparatus of claim 28, wherein determining whether the first frame is potentially unstable is based on whether the first frame is within a threshold number of frames after the erased frame.

36. The apparatus of claim 28, wherein determining whether the first frame is potentially unstable is based on whether any frame between the first frame and the erased frame utilizes non-predictive quantization.

* * * * *